US012320605B2

(12) United States Patent
Wilson

(10) Patent No.: US 12,320,605 B2
(45) Date of Patent: Jun. 3, 2025

(54) CONNECTOR FOR A FIREARM ACCESSORY

(71) Applicant: Bert John Wilson, Tauranga (NZ)

(72) Inventor: Bert John Wilson, Tauranga (NZ)

( * ) Notice: Subject to any disclaimer, the term of this patent is extended or adjusted under 35 U.S.C. 154(b) by 211 days.

(21) Appl. No.: 17/978,512

(22) Filed: Nov. 1, 2022

(65) Prior Publication Data

US 2023/0138685 A1 May 4, 2023

(30) Foreign Application Priority Data

Nov. 2, 2021 (AU) ..... 2021903497

(51) Int. Cl.
*F41A 21/32* (2006.01)

(52) U.S. Cl.
CPC ..... *F41A 21/325* (2013.01)

(58) Field of Classification Search
CPC ..... F41A 21/30; F41A 21/32; F41A 21/325; F41A 21/34; F41A 21/36; F41A 21/38
See application file for complete search history.

(56) References Cited

U.S. PATENT DOCUMENTS 4,510,843 A 4/1985 Rabatin
4,893,426 A 1/1990 Bixler
5,433,133 A 7/1995 La France
5,773,746 A * 6/1998 Vaden ..... F41A 21/325 89/14.4
6,385,891 B1 * 5/2002 Rabatin ..... F41A 21/325 42/79
7,891,282 B1 2/2011 Begroat
8,091,462 B2 1/2012 Dueck et al.
(Continued)

FOREIGN PATENT DOCUMENTS

WO 2007069086 A2 6/2007
WO WO-2019102510 A1 * 5/2019

OTHER PUBLICATIONS

Australian International Search Report in AU Application No. 2021903497, mailed Dec. 14, 2021 (13 pages).
(Continued)

*Primary Examiner* — Gabriel J. Klein
(74) *Attorney, Agent, or Firm* — Leason Ellis LLP

(57) ABSTRACT

A connector assembly for connecting a firearm accessory to a muzzle device for a firearm is disclosed. The connector assembly comprises a first connector part and a second connector part engaged to the first connector part by a threaded engagement. The first connector part presents a first engagement surface. At least two clamp members are configured to receive the muzzle device therebetween, the clamp members coupled to the second connector part to be axially and rotationally retained thereto. Each of the clamp members presents a second engagement surface to engage the first engagement surface. Rotation of the first connector part relative to the second connector part in a first direction moves the first connector part from a first relative axial position to a second relative axial position to engage the first engagement surface against the second engagement surfaces, to drive the clamp members radially inwards against the muzzle device in an inward radial position, to thereby clamp the muzzle device and connect the firearm accessory to the firearm.

12 Claims, 20 Drawing Sheets

(56) References Cited

U.S. PATENT DOCUMENTS

| | | | | |
|---|---|---|---|---|
| 8,291,805 | B1 * | 10/2012 | Quilligan | F41A 21/325 285/305 |
| 8,490,535 | B1 * | 7/2013 | Moore | F41A 21/34 42/1.06 |
| 8,499,676 | B1 * | 8/2013 | Moore | F41A 21/325 89/14.4 |
| 8,714,300 | B2 | 5/2014 | Johansen | |
| 9,927,201 | B2 * | 3/2018 | Penchuk | F41A 21/325 |
| 11,209,233 | B1 * | 12/2021 | Oglesby | F41A 21/32 |
| 11,397,065 | B2 * | 7/2022 | Vanhatalo | F41A 21/325 |
| 2012/0180623 | A1 | 7/2012 | Graham, II et al. | |
| 2014/0237881 | A1 | 8/2014 | Mack | |
| 2016/0097609 | A1 * | 4/2016 | Penchuk | F41A 21/325 42/76.01 |
| 2016/0161203 | A1 * | 6/2016 | Wilson | B23K 35/325 89/14.3 |
| 2018/0017352 | A1 * | 1/2018 | Addis | F41A 21/36 |
| 2018/0292164 | A1 * | 10/2018 | Thompson | F41A 21/36 |
| 2019/0353446 | A1 * | 11/2019 | Kras | F41A 21/325 |
| 2021/0102774 | A1 * | 4/2021 | Vanhatalo | F41A 21/325 |
| 2023/0138685 | A1 * | 5/2023 | Wilson | F41A 21/325 89/14.05 |

OTHER PUBLICATIONS

Non Final Office Action in U.S. Appl. No. 14/745,949, mailed Aug. 22, 2017 (12 pages).

* cited by examiner

CONNECTOR FOR A FIREARM ACCESSORY

CROSS-REFERENCE TO RELATED PATENT APPLICATIONS

This application claims the priority of Australian Patent Application 2021903497, filed Nov. 2, 2021, which is incorporated by reference as if expressly set forth in its entirety herein.

TECHNICAL FIELD

The present invention relates to suppressors for guns. In particular, the invention relates to a connector assembly for attaching a firearm accessory such as a suppressor to a muzzle device such as a flash hider attached to the muzzle of a firearm.

BACKGROUND ART

A gun is a device that uses the expansion of a gas to propel a projectile. The gas can take several forms, such as compressed air stored in a canister attached to the gun. Firearms are a sub-type of gun that use the expansion of a gas created by combustion to propel a projectile. A combustible material such as gun powder is stored within a projectile cartridge. A firing mechanism in the firearm is used to ignite the combustible material. The combustion process creates the gas. The heat of combustion increases the temperature of the gas, which causes it to expand to an area of lower pressure.

The primary exit from the firearm is through the open end of the gun barrel. As a result, the gas expands towards the open end of the firearm barrel. That expansion is transferred to the projectile, propelling it out from the firearm barrel. The creation and expansion of the gas is a fast process. Accordingly, the projectile exits the firearm barrel at high speed.

The generation and expansion of the gas also creates significant noise in the form of a blast wave.

That blast wave is undesirable for a number of reasons. Firstly, the blast wave creates a loud noise, which can damage a person's ears. Repeated exposure to blast waves will result in hearing loss. Secondly, the noise of the blast wave makes the use of guns unpleasant. That may be relevant where people use guns for recreational purposes such as target shooting. Thirdly, the blast wave can create a safety hazard. For instance, police may use guns around volatile gases such as those present in meth labs, or the flash and noise may attract enemy fire.

Devices called suppressors or silencers are used to control the gas expansion and thereby minimise the adverse effects it creates.

One common type of suppressor is a device which is configured to be attached to the end of a gun barrel. These devices include an inlet and an outlet, and a connecting passageway. In-use a projectile fired by the gun passes through the inlet, along the passageway, exiting the suppressor via the outlet.

These suppressors include a series of internal baffles which define chambers within the suppressor. The gas generated during firing of the projectile is able to expand into the chambers. The chambers are arranged such that a first chamber is comparatively larger than the volume of the gun barrel. Accordingly, the first chamber provides a large volume into which the gas may expand. The gas can subsequently expand into adjacent chambers in the suppressor. Together, the chambers facilitate a gradual expansion of the gas. As a result, the expansion of the gas is slower than were the suppressor not used, which minimises the noise created by the blast wave. As the gas expands from the end of the gun barrel, unburnt fuel mixed with the gas exiting the gun barrel ignites causing a flame or 'flash' of fire to be emitted from the end of the barrel after the projectile has exited the firearm. Such a flash can affect the vision of the person firing the firearm, especially when firing the firearm at night. A flash emitted from the barrel of the firearm is therefore undesirable.

A flash hider is a muzzle device attached to an end of the gun barrel of a firearm to suppress or reduce the size of the flame or flash emitted from the end of the barrel upon firing. Many different flash hider designs are provided. One particular well known design is an 'A2' slotted flash comprising a cylindrical body with five longitudinal slots spaced apart around the body. Often a flash hider remains attached to the muzzle of a firearm. If noise suppression of the firearm is required a suppressor is preferably fitted over the flash hider, to fit the suppressor to the firearm without the need to remove the flash hider from the muzzle of the firearm. Connection arrangements for connecting a suppressor to a flash hider are known. However, these connection arrangements often present connection difficulties, in both connecting a noise suppressor to and removing from a flash hider. Flash hiders such as the A2 flash hider are a cheap commodity type item. The fitment of a noise suppressor to a flash hider can be a 'loose' or poor fit due to poor manufacturing tolerances of the flash hider. There also may be a lack of a seal between the suppressor and the flash hider which reduces the effectiveness of the suppressor. Also, with the lack of a seal, carbon deposits created during firing can reach connector components. A suppressor can be difficult to remove from a flash hider due to the build up of carbon deposits binding interfacing surfaces of the suppressor and the flash hider together.

Ideally the connection of a noise suppressor to a flash hider is secure and is quick and easy to make and break. Furthermore the connection of other firearm accessories such as blank firing adapters or blast redirectors to a muzzle device attached to the muzzle of a firearm should be secure and easy to make and break.

Accordingly, in light of the foregoing it would be advantageous to have an improved connector for connecting a noise suppressor or other firearm accessory to a flash hider or other muzzle device attached to the muzzle of a firearm which addresses any one or more of the foregoing problems.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

DISCLOSURE OF THE INVENTION

It is an object of the present invention to address one or more of the foregoing problems or at least to provide the public with a useful choice.

According to a first aspect of the present invention, there is provided a connector assembly for connecting a firearm accessory to a muzzle device for a firearm, the connector assembly comprising:

a first connector part, and a second connector part engaged to the first connector part by a threaded engagement, the first connector part presenting a first engagement surface, at least two clamp members configured to receive the muzzle device therebetween, the clamp members coupled to the second connector part to be axially and rotationally retained thereto, each of the clamp members presenting a second engagement surface to engage the first engagement surface, and wherein rotation of the first connector part relative to the second connector part in a first direction moves the first connector part from a first relative axial position to a second relative axial position to engage the first engagement surface against the second engagement surfaces to drive the clamp members radially inwards against the muzzle device in an inward radial position to clamp the muzzle device and connect the firearm accessory to the firearm.

Rotation of the first connector part relative to the second connector part in an opposite second direction moves the first connector part from the second relative axial position to the first relative axial position to allow the clamp members to move radially outwards from the inward radial position to an outward radial position to allow the connector assembly to be removed from the muzzle device.

In some embodiments, at least one said clamp member comprises a radially inwardly facing surface to engage a feature on the muzzle device to prevent relative rotation between the second connector part and the muzzle device when the clamp members are in the inward radial position.

In some embodiments, the radially inwardly facing surface is a flat surface to engage a spanner flat on the muzzle device or comprises a protrusion or an indent to engage a corresponding indent or protrusion on the muzzle device.

In some embodiments, the first engagement surface of the first connector part is an annular inclined surface, and/or the second engagement surface of each clamp member is a circumferentially extending portion of an annular inclined surface.

In some embodiments, the first and/or second engagement surface comprises a conical portion.

In some embodiments, each clamp member has a projection or recess engaging a corresponding recess or projection on the second connector part, the projection and/or recess extending perpendicular to the longitudinal axis of the connector assembly, to retain the clamp members axially and rotationally to the second connector part and provide for sliding movement therebetween to allow the clamp members to move radially.

In some embodiments, one or more of the clamp members comprises a (second) feature to engage a corresponding axial feature on the muzzle device to axially locate the connector assembly to the muzzle device.

In some embodiments, the feature of the clamp member is a radial inward projection to engage a recess on the muzzle device.

In some embodiments, each clamp member comprises a said feature such that the features extend substantially around the full circumference of the muzzle device to engage a corresponding annular feature on the muzzle device.

In some embodiments, the connector assembly comprises at least one spring between each clamp member and the second connector part to bias the clamp members radially inwards.

In some embodiments, the radially inward facing surfaces of the clamp members clamp the respective features on the muzzle device without a clamping force applied between other surfaces of the clamp members and the muzzle device.

In some embodiments, clamp members are configured so that there is a circumferential gap between adjacent clamp members when the clamp members are in the radially inward position.

In some embodiments, the clamp members are configured to substantially encircle an outer surface of the muzzle device when in the radial inward position and clamped to the muzzle device.

In some embodiments, the clamp members are configured to form a substantially continuous ring around the muzzle device when in the inward radial position.

In some embodiments, the clamp members are configured to provide a circumferential seal extending substantially around a full circumference of the muzzle device when in the radial inward position and clamped to the muzzle device.

In some embodiments, the circumferential seal is between the clamp members and the muzzle device and/or between the first engagement surface and the second engagement surfaces.

In some embodiments, the clamp members are configured so that, at an axial location of the muzzle device, a maximum radial gap between the clamp members and a circumference of the muzzle device is less than about 500 microns, or less than about 200 microns, or about 100 microns or less when the clamp members are in the radial inward position and clamped to the muzzle device.

In some embodiments, the clamp members are configured so that a circumferential gap between adjacent clamp members is less than about 500 microns, or less than about 200 microns, or about 100 microns or less when in the radial inward position and clamped to the muzzle device.

In some embodiments, the connector assembly comprises a mechanism to drive the clamp members from the inward radial position to an outward radial position when the first connector part is in or moved to the first relative axial position to allow a muzzle device to be received in or removed from the connector assembly.

In some embodiments, the mechanism is a wedge or cam mechanism comprising one or more wedge members or cam surfaces configured to engage each or a respective clamp member to drive the clamp members radially outwards.

In some embodiments, each wedge member comprises a first wedge surface to engage a corresponding surface on a said clamp member and an oppositely arranged second wedge surface to engage a corresponding surface on an adjacent said clamp member, wherein the wedge member is moved relative to the clamp members to drive the clamp members radially apart.

In some embodiments, the wedge members move radially.

In some embodiments, the clamp members move on a first radial line and the wedge members move on a second radial line perpendicular to the first radial line, and the first and second wedge surfaces and/or the corresponding surfaces are inclined to the second radial line so that when the first connector part is in the first relative axial position, movement of the wedge members from a radial outwards position to a radial inwards position drives the clamp members radially outwards.

In some embodiments, the wedge members are configured to be pressed inwards by a user to move the clamp members radially outwards when the first connector part is in the first relative axial position.

In some embodiments, the wedge members move axially relative to the second connector part and the clamp members, wherein the first and second wedge surfaces and/or the corresponding surfaces on the clamp members are inclined to a longitudinal line on which the wedge members move so that axial movement of the wedge members drives the clamp members radially outwards.

In some embodiments, the wedge members are rotationally coupled to the first connector part to move axially with the first connector part and allow relative rotation therebetween so that:

as the first connector part is moved axially towards the second connector part from the first relative axial position to the second relative axial position, the wedge members move axially to allow the clamp members to move radially inwards to the inward radial position to clamp the muzzle device, and as the first connector part is moved axially away from the second connector part from the second relative axial position to the first relative axial position, the wedge members move axially relative to the clamp members to drive the clamp members to move radially outward.

In some embodiments, the wedge members are integrally formed together with a ring in a single wedge component.

In some embodiments, the wedge component is rotationally coupled to the first connector part to move axially with the first connector part and allow relative rotation therebetween.

In some embodiments, the cam mechanism comprises a cam component rotationally coupled to the second connector part to rotate relative to the second connector part, the cam component comprising a cam surface or cam follower to act on a corresponding cam follower or cam surface on each clamp member, wherein rotation of the cam component from a first position to a second position relative to the second connector part causes the cam followers to move along the cam surfaces to move the clamp members radially outwards from the radial inward position to the radial outward position.

In some embodiments, the mechanism comprises a lever pivotally coupled to each clamp member to drive the clamp members from the radial inwards (clamped) position to the radial outwards position.

In some embodiments, each lever is pivotally coupled at a fulcrum to the second connector part, a coupled end of the lever is pivotally coupled to a clamp member and a free end of the lever extends from the fulcrum to be accessible from an outside of the second connector part, and with the clamp members at the radially inward position, each lever is pivoted about the fulcrum to present the free end of each lever at an outward position, and pressing the free ends of the levers move the free ends to an inwards position, pivoting the levers at the fulcrum to move the coupled end of the levers and the clamp members to the radially outwards position.

In some embodiments, the clamp members are captured axially between the first connector part and the second connector part.

In some embodiments, the connector comprises two diametrically opposed clamp members.

In some embodiments, the first connector part is screwed to or integrally formed with a body of the firearm accessory at an entry end of the body.

In some embodiments, the mechanism for driving the clamp members from the inward radial position to the outward radial position comprises a cam component configured to engage an outer surface of the second connector part and to move longitudinally with respect to the first and second connector parts.

In some embodiments, the cam component does not rotate relative to the second connector component.

In some embodiments, the clamp members are provided inside the second connector component and the second connector component comprises apertures in opposed sides thereof, the apertures configured to allow cam follower portions provided at opposite ends of each clamp member to extend through the apertures, and wherein the cam component comprises a substantially cylindrical outer wall and two pairs of cam races provided to an inner surface of the cylindrical outer wall, each cam race configured to engage a respective cam follower.

In some embodiments, the connector comprises biasing means provided between the cam component and the second connector component and configured to bias the cam component towards the first connector component.

In some embodiments, the cam component comprises first indexing means configured to engage second indexing means provided to the first connector component, the indexing means configured to resist relative rotation of the cam component and the first connector component when the first indexing means is engaged with the second indexing means.

In examples, the first and/or second engagement surfaces comprise conical portions and wherein the second connector part comprises a further conical portion configured to engage the clamp members to drive the clamp members radially inwards against the muzzle device.

In examples, each clamp member comprises a tapered projection on a first longitudinal face and a complementary recess on an opposite longitudinal face, such that in use, the tapered projection of one of the clamp members engages the recess of the other clamp member.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

BRIEF DESCRIPTION OF THE DRAWINGS

Further aspects of the present invention will become apparent from the ensuing description which is given by way of example only and with reference to the accompanying drawings in which:

FIG. 12A is an isometric view, FIG. 12B is an end view, and FIG. 12C is a side view showing a radially inward side of the clamp member.

FIG. 22A is an isometric view, FIG. 22B is an end view, and FIG. 22C is a side view.

FIG. 34A is an isometric view, FIG. 34B is an end view, and FIG. 34C is a side view.

FIG. 45A is an isometric view, FIG. 45B is an end view, and FIG. 45C is a side view.

DETAILED DISCUSSION OF PREFERRED EMBODIMENTS

First Embodiment

Figure 1:
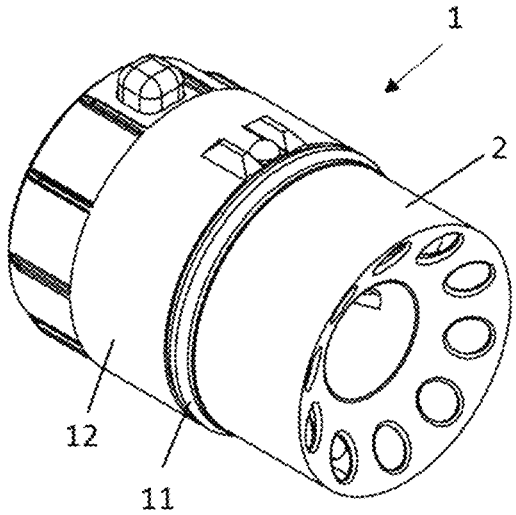
FIG. 1 is an isometric view of a connector assembly according to the present invention.
Figure 2:
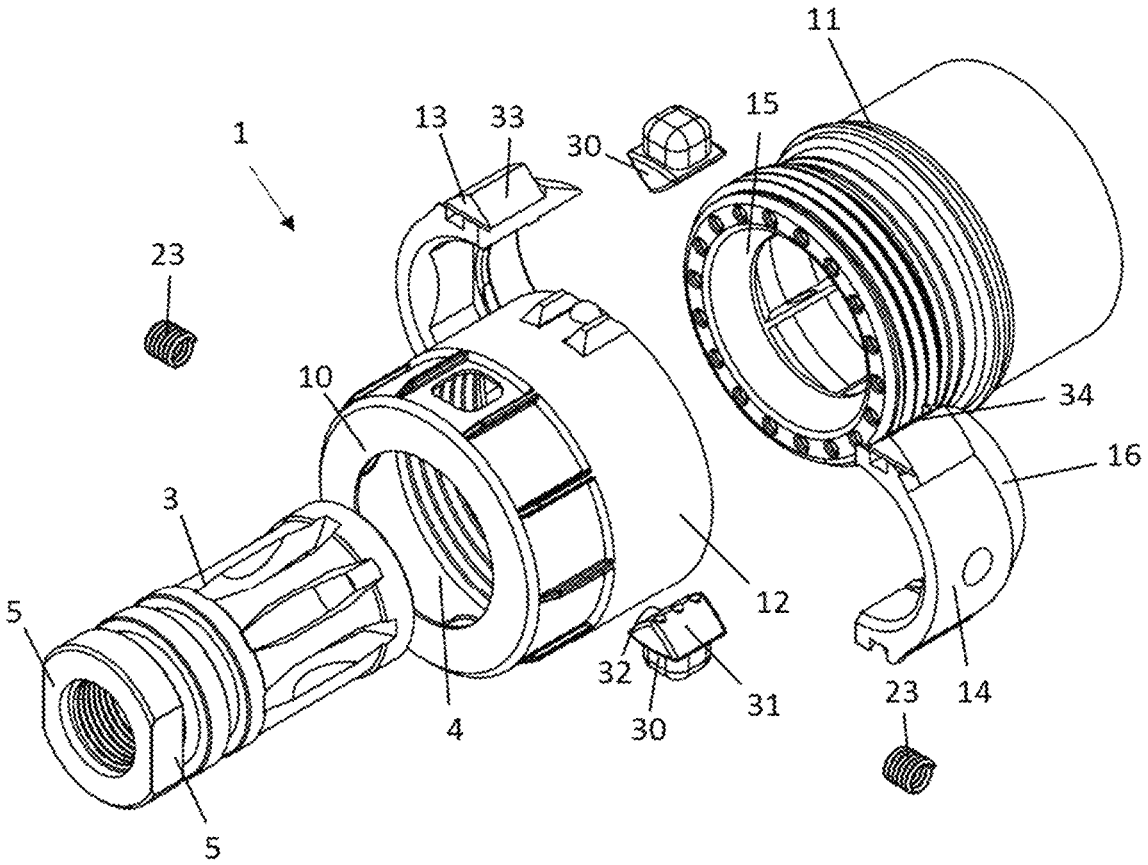
FIG. 2 is an exploded isometric view of the connector assembly of FIG. 1 together with a flash hider.
Figure 3:
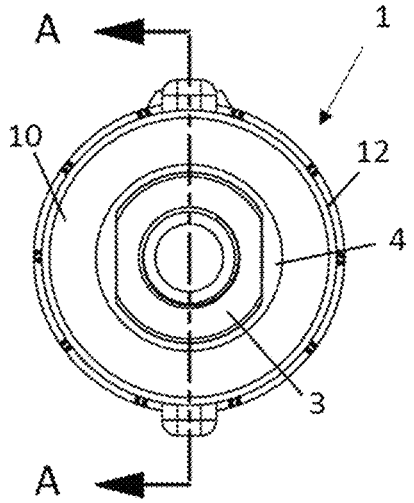
FIG. 3 is a view on an entry end of the connector assembly with flash hider received therein and with the connector assembly in a clamped position.
Figure 4:
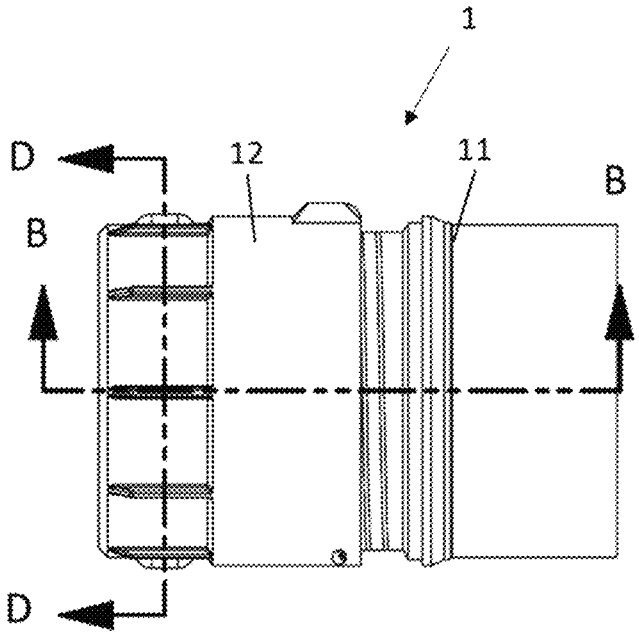
FIG. 4 is a side view of the connector assembly with the connector assembly in an unclamped position and with a wedge mechanism pressing clamp members of the assembly radially outwards.

A connector assembly 1 for connecting a suppressor 2 to a flash hider 3 is described with reference to FIGS. 1 to 12C. In use the flash hider 3 is connected to a muzzle of a firearm (not shown). The connector assembly 1 connects a suppressor 2 to the flash hider 3, thus connecting the suppressor to the firearm via the flash hider.

The connector 1 has a first connector part 11 and a second connector part 12. Each of the first and second connector parts are collars or annular members. The first and second connector parts 11, 12 are engaged together. The first and second connector parts are engaged by a threaded engagement. The first and second connector parts are threaded together to connect the suppressor to the flash hider.

The first connector part 11 may be connected to an entry end of a suppressor 2, for example by a threaded connection, or may be internally formed with an entry end of the suppressor 2. In the illustrated embodiment, the first connector part 11 is integrally formed with a suppressor body 2 of the suppressor at an entry end of the suppressor body. Only a portion (i.e. the entry end) of the suppressor body 2 is shown. The second connector part 12 is a nut (a back nut) that is engaged to the first connector part 12. The second connector part 12 has an aperture 4 to receive the flash hider 3

While in the illustrated embodiment the first connector part is connected to the suppressor and the flash hider is received via the aperture in the second connector part, in an alternative embodiment, the second connector part may be connected to or integrally formed with a suppressor and the first connector part may form a back nut with an aperture to receive the flash hider into the connector assembly.

In accordance with the present invention, the connector has at least two clamp members 13, 14 to be arranged about an outer surface of the flash hider 3. The clamp members 13, 14 are received in the second connector part 12. The flash hider 3 is inserted into the connector assembly 1 via the aperture 4 to be received between the clamp members 13, 14, and the flash hider 3 is removed from the connector assembly 1 via the aperture 4. In the illustrated embodiment there are two diametrically opposed clamp members. However, there may be more than two clamp members to surround the flash hider when inserted into the connector assembly. The clamp members extend around a longitudinal axis of the connector assembly 1 to in use extend around and clamp to the flash hider.

The first connector part 11 has a first engagement surface 15 and each of the clamp members has a second engagement surface 16. The first engagement surface 15 and/or the second engagement surfaces 16 are cam surfaces so that engagement between the first engagement surface and the second engagement surfaces by axial relative movement drives the clamp members 13, 14 radially inwards. The first engagement surface 15 and/or the second engagement surfaces 16 are tapered or inclined to the longitudinal axis of the connector assembly so that engagement between the first engagement surface and the second engagement surfaces by axial relative movement drives the clamp members 13, 14 radially inwards to clamp the outer surface of the flash hider.

For example, the first engagement surface 15 comprises an annular inclined surface, and/or each of the second engagement surfaces 16 comprises a circumferential portion of an annular inclined surface. The first engagement surface may be a truncated or part-conical surface and/or each of the second engagement surfaces may be a circumferential portion of a truncated or part-conical surface. The first engagement surface 15 faces radially inwards and the second engagement surfaces face radially outwards 16, so that axial movement of the first connector part 11 towards the clamp members 13, 14 drives the clamp members radially inwards. A truncated/part conical surface and a circumferential portion of a truncated/part conical surface may simply be referred to as a 'conical surface', as in a 'conical' sealing surface. In the illustrated embodiment, the first engagement surface 15 is a conical surface and each second engagement surface 16 is a conical surface.

The clamp members 13, 14 are retained relative to the second connector part 12 in an axial direction. Rotation of the first connector part 11 relative to the second connector part 12 moves the first and second connectors parts 11, 12 axially together and therefore moves the first connector part 11 axially towards the clamp members 13, 14 to engage the first engagement surface 15 against the second engagement surfaces 16 to drive the clamp members 13, 14 radially inwards. With the first engagement surface engaging the second engagement surfaces, the clamp members are captured axially between the first and second connector parts, for example between the first engagement surface 15 on the first connector part and a flange 10 on the second connector part. Each clamp member 13, 14 has a radially inwardly facing surface 17 to engage a surface or feature on the flash hider 3. Thus, rotation of the first connector part 11 relative to the second connector part 12 drives the clamp members 13, 14 radially inwards so that the radially inwardly facing surfaces 17 of the clamp members engage the flash hider 3 to clamp the connector to the flash hider.

The radial inwardly facing surface 17 of at least one of the clamp members engages a feature on the flash hider to prevent rotation of the second connector part relative to the flash hider. In the illustrated embodiment, each clamp member 13, 14 comprises a radially inwardly facing surface 17 to clamp to a spanner flat 5 on the flash hider 3. The surface 17 engages a spanner flat to prevent relative rotation between the second connector part and the flash hider. For example, each clamp member 13, 14 has a flat radially inwardly facing surface 5 to clamp to a respective spanner flat 5 on the flash hider 3. For example, an A2 flash hider (as illustrated in the Figures) has two diametrically opposed spanner flats 5, and each diametrically opposed clamp member 13, 14, has a corresponding (flat) surface 17 to engage the respective spanner flat. In some embodiments the radially inwardly facing surface 17 may be configured to clamp to more than one flat or spanner flat on the flash hider, for example two adjacent spanner flats (such as on an FN flash hider) or may be configured to clamp to other features on the flash hider. An FN flash hider has a hex and each clamp member may have a surface 17 to engage a respective spanner flat of the hex. A Surefire™ flash hider has a locking protrusion and one clamp member may have a radially inwardly facing surface configured to engage the protrusion to prevent relative rotation therebetween. An SA80 flash hider has a bayonet locking recess or indent and one clamp member 13, 14 may have a radially inwardly facing surface configured to engage a respective recess or indent to prevent relative rotation therebetween.

Figure 5:
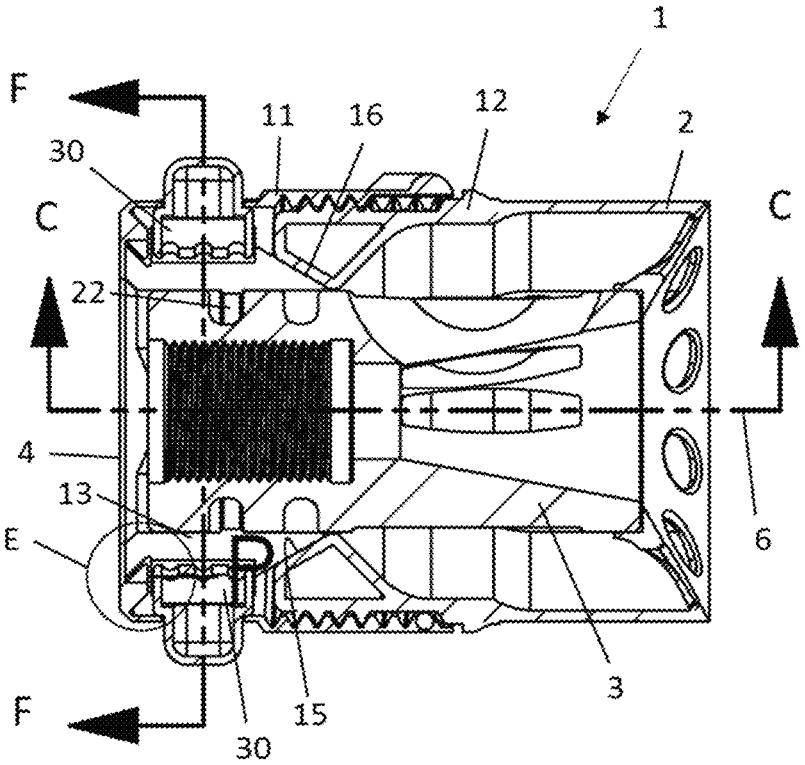
FIG. 5 is a sectional view on section line A-A in FIG. 3 with the connector assembly in the clamped position and connected to the flash hider.
Figure 6:
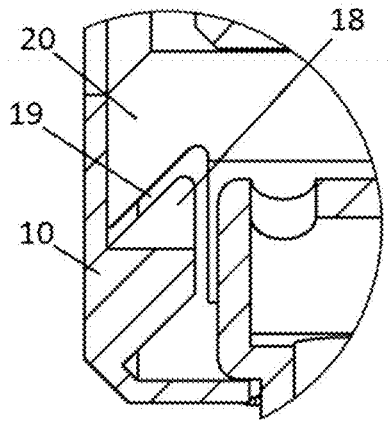
FIG. 6 is an enlarged view showing details in the circle designated E in FIG. 5.
Figure 12A:
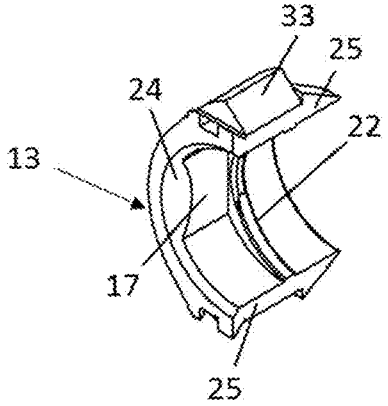
FIGS. 12A to 12C show a clamp member of the connector assembly.
Figure 12B:
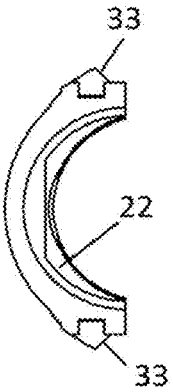
Figure 12C:
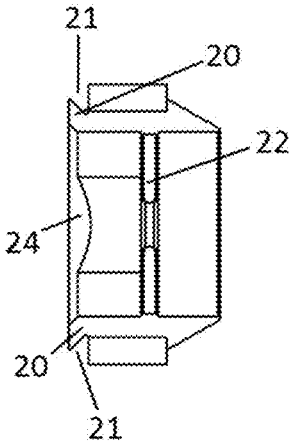
Figure 13:
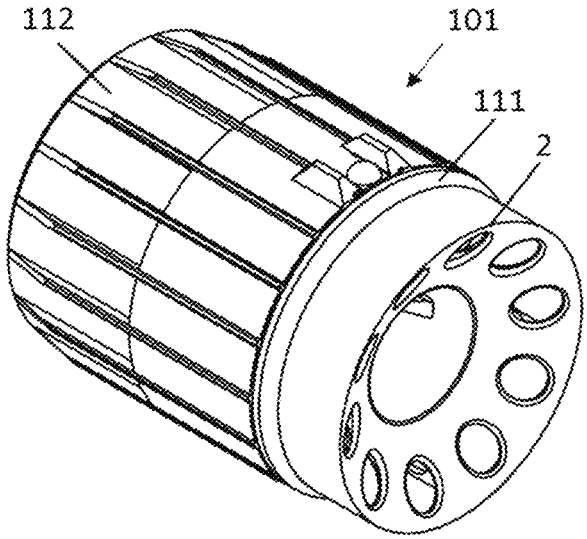
FIG. 13 is an isometric view of another connector assembly according to the present invention.
Figure 14:
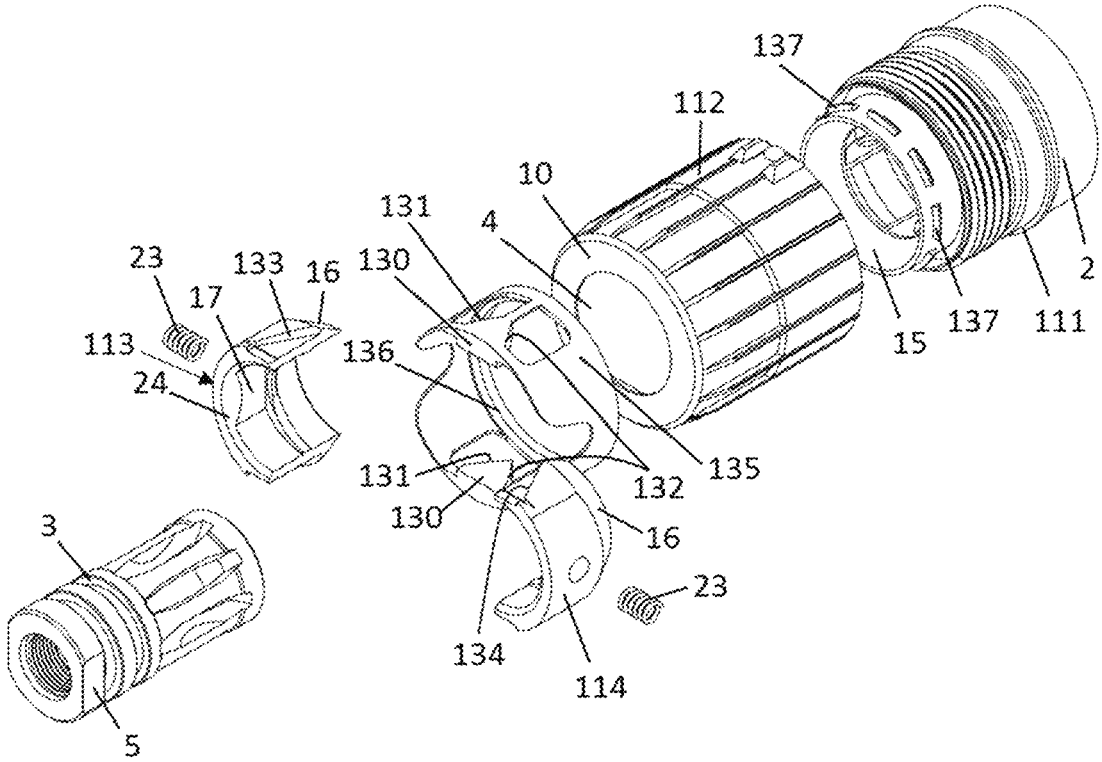
FIG. 14 is an exploded isometric view of the connector assembly and flash hider shown in FIG. 13.
Figure 15:
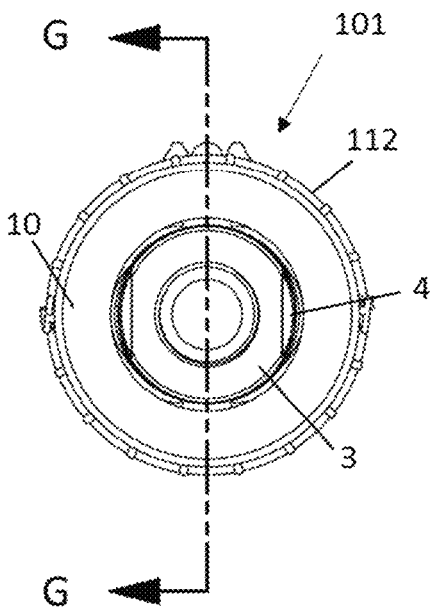
FIG. 15 is a view on an entry end of the connector assembly of FIG. 13 with flash hider received therein and with the connector assembly in an unclamped position.
Figure 16:
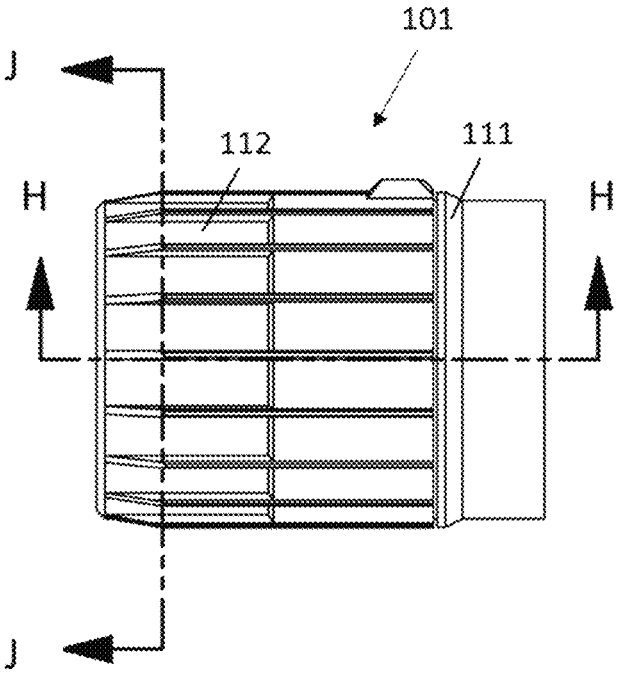
FIG. 16 is a side view of the connector assembly with the connector assembly in a clamped position and connected to the flash hider.
Figure 17:
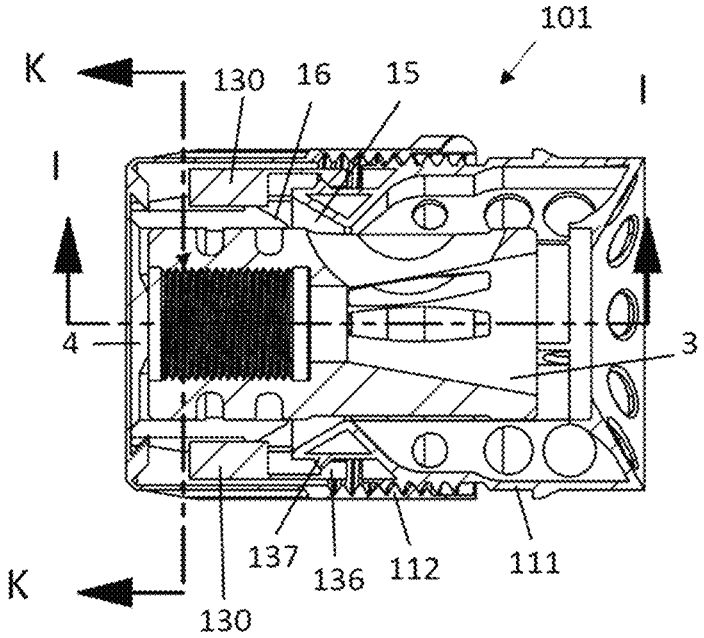
FIG. 17 is a sectional view on section line G-G in FIG. 15 showing the connector assembly in the unclamped position with the flash hider received therein.

With reference to FIGS. 5, 6 and 12C, to axially retain the clamp members 13, 14 to the second connector part 12 and allow for radial movement of the clamp members 13, 14, the second connector part 12 has a rail or projection 18 and/or recess or groove 19 to engage a corresponding rail/projection 20 and/or recess/groove 21 on each clamp member. The projections/rails or recess/grooves extend perpendicular to the longitudinal axis (6 in FIG. 5) of the connector assembly. The projections/rails move along the corresponding recesses/grooves so that the clamp members move radially and perpendicular to the longitudinal axis of the connector assembly while preventing axial and rotational movement between the clamp members 13, 14 and the second connector part 12. As shown in FIGS. 5 and 12C, each clamp member has a pair of projections or recesses that are radially spaced apart in a radial direction perpendicular to a radial direction in which the clamp member move. The pair of projections or recesses 20, 21 are captured by a corresponding pair of projections or recesses on the second connector part 12, so that the clamp members are only free to move relative to the second member radially inwards and radial outwards on a plane coincident with and perpendicular to the longitudinal axis of the connector assembly. Thus each clamp member is restrained to move with a single degree of freedom only, being in a radial direction of the connector assembly. The clamp members are axially and rotationally fixed or retained to the second connector part. The clamp members are coupled to the second connector part so that relative axial and rotational movement between the clamp members and the second connector part is substantially prevented. Preventing relative rotation between the second connector part and the flash hider allows the first connector part 11 to be rotated relative to the second connector part to clamp the connector assembly to the flash hider without a requirement to hold the second connector part stationary.

One or more clamp members 13, 14 may further comprise a feature to engage a corresponding axial feature on the flash hider to axially locate the connector assembly to the flash hider. In the illustrated embodiment each clamp member 13, 14 includes a radial projection 22 (refer FIG. 12A) to engage an annular recess 7 on the flash hider. The projection 22 extends circumferentially around an inner side of the clamp member 13, 14. Alternatively each clamp member may comprise a circumferential groove to engage a circumferential projection on the flash hider.

Figure 7:
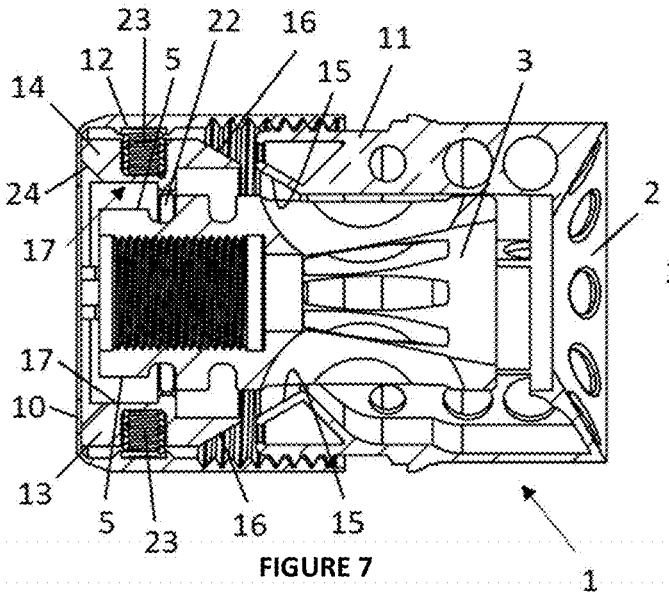
FIG. 7 is a sectional view on section line B-B in FIG. 4 with the connector assembly in the unclamped position and clamp members radially outwards.

In use, the connector assembly 1 is fitted over the flash hider 3 with the first and second connector parts 11, 12 in a first relative position such that clamp members 13, 14 are moveable to an outward radial position. With the clamp members in the radial outward position the flash hider may be inserted into the connector assembly via the aperture 4 so that the flash hider 3 is received in the connector assembly 1 between the clamp members 13, 14, as shown in FIG. 7. The connector assembly 1 may be rotated (if necessary) so that the radially inwardly facing surfaces 17 of the clamp members 13, 14 locate to the corresponding features (the spanner flats in the illustrated embodiment) on the flash hider.

In a preferred embodiment, the connector assembly has at least one spring 23 between each clamp member 13, 14 and the second connector part 12, to bias the clamp member from the outward radial position to an inward radial position. In the inward radial position, the radially inward surface 17 of at least one clamp member 13, 14 engages the respective feature on the flash hider to prevent relative rotation between the clamp members and therefore the second connector part. The springs provide a sufficient radial inward force to hold the clamp members in the radially inward position to prevent relative rotation between the clamp members and the flash hider, and therefore prevent relative rotation between the second connector part and the flash hider. Preferably the spring force is sufficient to allow the first connector part to be tightened onto the second connector part without a requirement to hold the second connector part stationary. Ends of springs (e.g. coil compression springs) may be located in a recess in the second connector part and a corresponding recess in the clamp member, as illustrated in FIGS. 7 to 11.

Figure 11:
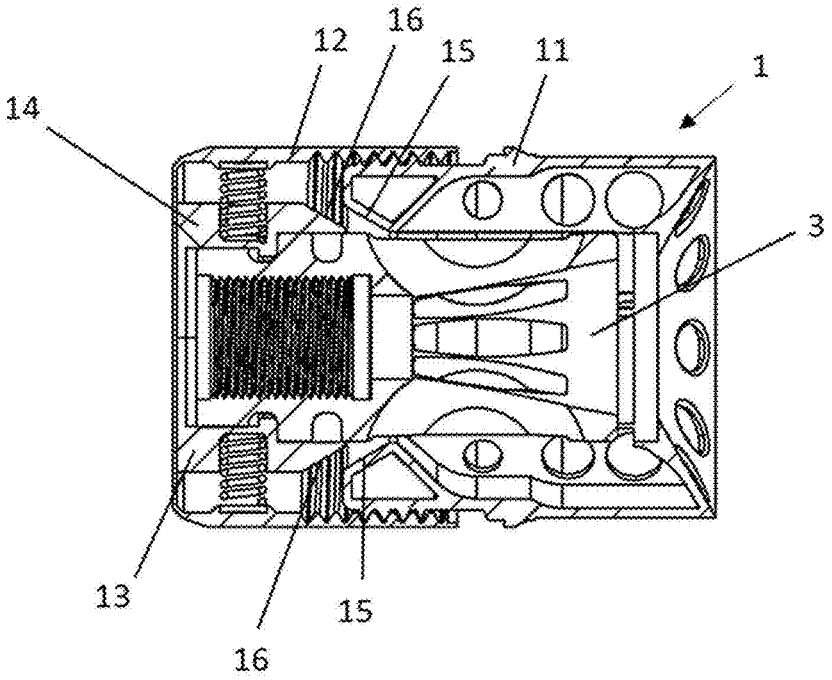
FIG. 11 is a sectional view on section line B-B in FIG. 4 with the connector assembly in the unclamped position but with wedge members in a radial outward position and clamp members in a radial inward position.

With the first and second connector parts 11, 12 in the first relative axial position (FIG. 7) the connector assembly may be pushed over the flash hider. In some embodiments, an annular tapered/inclined surface or annular bevel 24 on a rear end of the clamp members may contact a front edge of the flash hider 3 to force the clamp members radially outwards against the spring bias as the connector assembly 1 is pushed onto the flash hider. Once the radially inwardly facing surfaces 17 of the clamp members 13, 14 align with the corresponding features on the flash hider, the clamp members 13, 14 move to the radial inward position under action of the spring bias (FIG. 11). If a user pushes the connector assembly 1 onto the flash hider with the radial inwardly facing surfaces 17 azimuthally misaligned from the respective features on the flash hider, the user may rotate the connector assembly 1 relative to the flash hider to locate the radial inwardly facing surfaces 17 of the clamp members 13, 14 to the respective features on the flash hider 3 so that the clamp members move to the radially inward position.

With the clamp members in the radially inwards position, the connector assembly is axially aligned to the flash hider. For example, the inward projections 22 of the clamp members 13, 14 are received in the annular recess of the flash hider 3. The connector assembly 1 may be axially aligned to the flash hider and with the radially inwardly facing surfaces 17 of the clamp members engaged with the respective features of the flash hider but unclamped to the flash hider, with the first and second connector parts in the first relative position, as shown in FIG. 11.

To connect (clamp) the connector assembly 1 to the flash hider the first connector part 11 is rotated relative to the second connector part 12 (and clamp members 13, 14) in a first direction of rotation to move the first connector part axially towards the second connector part 12 (and therefore the clamp members) to a second relative axial position. The first connector part is rotated relative to the flash hider while the second connector part carrying the clamp members remains stationary relative to the flash hider. As the first connector part 11 is moved axially towards the clamp members 13, 14 the first engagement surface 15 moves along or against the second engagement surfaces 16 to drive the clamp members 13, 14 radially inwards to clamp the radially inward facing surfaces 17 of the clamp members 13, 14 to the flash hider, as described above, and as illustrated in FIGS. 9 and 10.

To securely clamp the connector assembly to the flash hider, the radially inward facing surfaces 17 of the clamp members 13, 14 may clamp the respective features on the flash hider without a clamping force applied between other surfaces of the clamp members 13, 14 and the flash hider, so that the clamp members clamp to the respective features on the flash hider only. Features of the flash hider, such as the spanner flats or other features such as protrusions or indents, may be machined and/or have a higher tolerance compared to other surfaces of the flash hider. Clamping to such features may improve repeatability and ensure a tight secure connection between the connector assembly and the flash hider.

Other than at the radially inwardly facing surfaces 17 of the clamp member 13, 14 that engage the feature on the flash hider, the clamp members may be configured to provide a clearance space between the inside of the clamp members and an outside of the flash hider, so that the clamp members clamp to the respective features on the flash hider only. For example, the clamp members are configured to provide a clearance space between the clamp members and an outside diameter of the flash hider.

Furthermore, to ensure the clamp members clamp to the respective features on the flash hider, when in the radially inward position, there may be a gap between adjacent clamp members 13, 14. For example, there is a gap between longitudinal faces 25 (FIG. 12A) of adjacent clamp members 13, 14 with the clamp members clamped to the flash hider.

In a preferred embodiment, the clamp members 13, 14 provide a circumferential seal extending substantially around a full circumference of the flash hider 3. Preferably the clamp members 13, 14 together substantially encircle an outer surface of the flash hider when clamped to the flash hider. The circumferential seal is preferably sufficient to prevent or restrict carbon deposits creating during firing of the firearm passing from the flash hider and rearwardly past the clamp members and/or provides a gas seal to substantially prevent gases escaping rearwardly from the suppressor. The circumferential seal may be provided at an exit side of the radial inwardly facing surfaces of the clamp members, i.e. at a location axially between the radial facing surfaces 17 and an exit end of the clamp members.

In some embodiments, a circumferential seal is formed between the clamp members and the flash hider. As described above, other than at the radially inwardly facing surfaces of the clamp member that engage the feature on the flash hider, the clamp members are configured to provide a clearance space between the inside of the clamp members and an outside of the flash hider. To provide a circumferential seal between the clamp members and the flash hider, preferably a clearance space or radial gap at a circumference of the flash hider between the flash hider and the clamp members is very small. For example, with the clamp members clamped to the corresponding features of the flash hider, at an axial location of the flash hider, the clamp members are configured to provide a maximum radial clearance space or gap around the circumference of the flash hider of less than about 500 microns, or less than about 400 microns, or less than about 300 microns, or less than about 200 microns, or about 100 microns or less.

As described above, to ensure the clamp members clamp to the respective features of the flash hider, the clamp members are configured so that there is a gap between adjacent clamp members when the clamp members are clamped to the flash hider. To provide a circumferential seal around the flash hider, preferably the gap between adjacent clamp members is very small. For example, with the clamp members clamped to the corresponding features of the flash hider, the clamp members are configured to provide a gap between adjacent clamp members (e.g. a gap between longitudinal faces 25 of adjacent clamp members 13, 14) of less than about 500 microns, or less than about 400 microns, or less than about 300 microns, or less than about 200 microns, or about 100 microns or less. Therefore, when clamped to the flash hider with the radially inwardly facing surfaces 17 engaging the respective features on the flash hider, the clamp members 13, 14 form a substantially continuous ring around the flash hider.

As described above, the clearance space or radial gap between the substantially continuous ring and the flash hider may very small to provide a circumferential seal between the clamp members and the flash hider. Alternatively, or additionally, the substantially continuous ring forms a circumferential seal between the first engagement surface 15 of the first (or second) connector part 11 and the engagement surfaces 16 of the clamp members 13, 14. In such an embodiment, the first engagement surface and the second engagement surfaces are first and second sealing surfaces.

The substantially continuous ring provided by the clamp members 13, 14 encircling the flash hider is intended to reduce or prevent carbon deposits reaching clamped surfaces 17 and associated components of the connector assembly 1 to reduce the chance of the connector assembly binding to the flash hider. Alternatively, or additionally, the continuous ring provided by the clamp members is intended to provide a substantial gas seal to prevent or reduce gases escaping rearwardly from the suppressor, resulting in an improved efficiency in the suppression of noise. Furthermore, the radial inward projections 22 preferably extend substantially around the full circumference of the flash hider and may assist with providing a seal and/or a barrier to carbon deposits passing rearwardly. In an alternative embodiment, the flash hider may comprise an annular projection, and the clamp members may provide an annular groove to extend substantially around the full circumference of the flash hider to receive the annular projection.

To remove or disconnect the connector assembly 1 from the flash hider, the first connector part 11 is rotated relative to the second connector part 12 (and clamp members 13, 14) in a second direction of rotation to move the first connector part axially away from the second connector part from the second relative axial position to the first relative axial position. As the first connector part is moved axially away from the second connector part the first engagement surface 15 moves along or away from the second engagement surfaces 16 to allow the clamp members 13, 14 to move radially outwards to unclamp the radially inward facing surfaces 17 of the clamp members from the flash hider. When the clamp members have moved radially outwards to the radial outward position the connector assembly can be removed from the flash hider.

Figure 8:
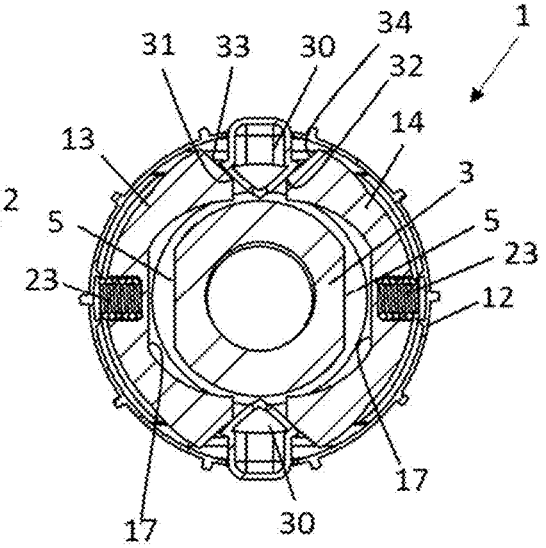
FIG. 8 is a sectional view on section line D-D in FIG. 4 with the connector assembly in the unclamped position and clamp members radially outwards.
Figure 9:
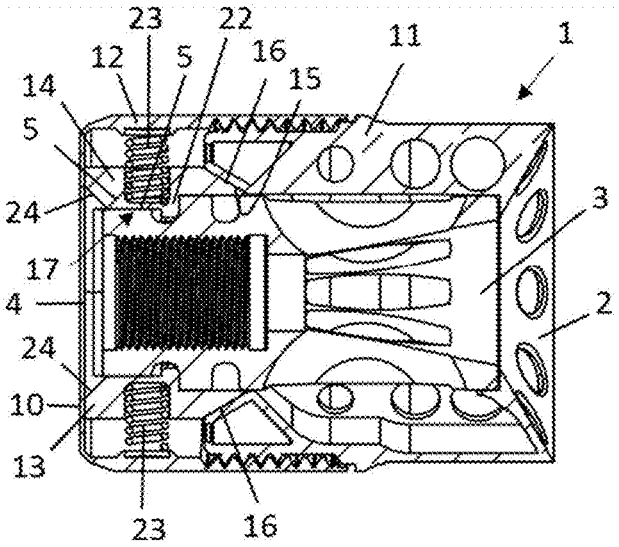
FIG. 9 is a sectional view on section line C-C in FIG. 5 with the connector assembly in the clamped position and connected to the flash hider.

In a preferred embodiment, and as shown in the illustrated embodiment, the connector assembly includes a wedge mechanism to drive the clamp members 13, 14 from the radial inwards position to the radial outwards position to allow the flash hider to be inserted into and removed from the connector assembly. FIGS. 7 and 8 show the wedge mechanism operated to drive the clamp members to the radial outwards position.

The wedge mechanism comprises one or more wedge members 30 configured to engage each clamp member 13, 14 to drive the clamp members radially outwards. In the illustrated embodiment the wedge mechanism comprises two wedge members 30. Each wedge member comprises a first wedge surface 31 to engage a corresponding surface 33 on one clamp member 13 (a first said clamp member) and an oppositely arranged second wedge surface 32 to engage a corresponding surface 34 on an adjacent clamp member 14 (a second clamp member). The wedge member 30 is moved relative to the clamp members 13, 14 to wedge the adjacent clamp members apart. The clamp members 13, 14 are restrained to move radially relative to the central axis of the connector assembly, as described above. The wedge members wedge or drive the clamp members radially apart. The wedge members move radially. The wedge members 30 move perpendicular to a radial direction on which the clamp members 13, 14 move. Thus, the clamp members 13, 14 move on a first radial line and the wedge members 30 move on a second radial line perpendicular to the first radial line. As the wedge members move radially inwards, the clamp members move radially outwards. The first and second wedge surfaces 31, 32 and/or the corresponding surfaces 33, 34 are inclined to the radial line on which the wedge members move so that movement of the wedge members from a radial outwards position to a radial inwards position drives the clamp members radially outwards.

Figure 10:
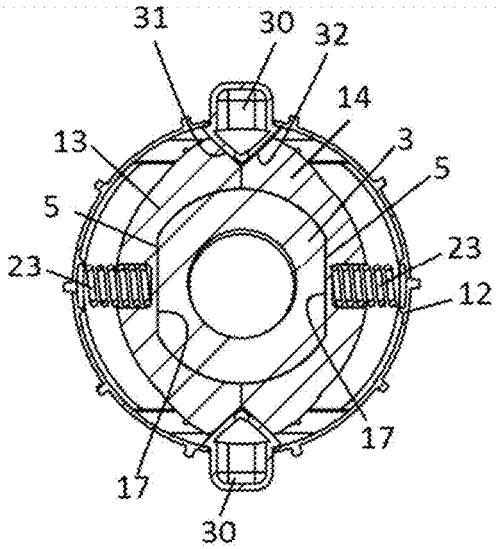
FIG. 10 is a sectional view on section line F-F in FIG. 5 with the connector assembly in the clamped position and connected to the flash hider.

To connect the connector assembly to the flash hider, the wedge members 30 are pressed inwards to move the clamp members to the radial outwards position and the connector assembly is fitted over the flash hider 3. For example, in the illustrated embodiment, each wedge member extends through an aperture in the second connector part to be accessible from an outside of the connector assembly. Where fitted, the springs drive the clamp members to the radial inward position when the wedge members are released, to engage the flash hider. The biasing of the springs biases the clamp members inwards and the wedge members outwards. The first connector part is then is rotated relative to the second connector part to clamp the clamp members to the flash hider as described above. To remove or disconnect the connector assembly 1 from the flash hider, the first connector part 11 is rotated relative to the second connector part 12 (and clamp members and wedge members) in a second direction of rotation to move the first connector part axially away from the second connector part and therefore the clamp members. As the first connector part is moved axially away from the clamp members the first engagement surface moves along or away from the second engagement surfaces to allow the clamp members to move radially outwards. Where springs are provided, the springs retain the clamp members in the radially inward position (FIGS. 10 and 11). The user moves the wedge members 30 from the radial outwards position to the radial inwards position to move the clamp members 13, 14 from the radial inwards position to the radial outwards position (FIGS. 7 and 8). The wedge members may be pressed radially inwards against the spring bias to move the clamp members radially outwards. When the clamp members have moved radially outwards to the radial outward position the connector assembly can be removed from the flash hider.

Second Embodiment

FIGS. 13 to 22C illustrate a second embodiment of a connector assembly 101 according to the present invention. Parts or features that are the same or similar to parts or features of the embodiment 1 described above with reference to FIGS. 1 to 12 are identified by the same reference numerals or with a prefix of 1. Various parts or features of connector assembly 101 that are the same as parts or features of the above embodiment connector assembly 1 are not described again for brevity.

Figure 18:
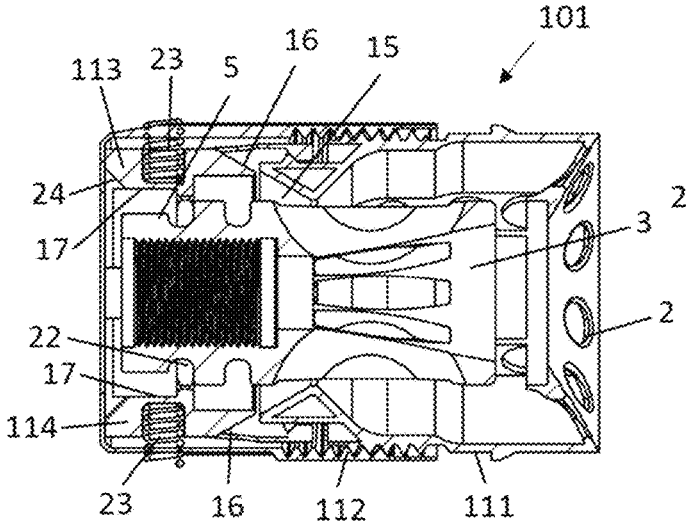
FIG. 18 is a sectional view on section line I-I in FIG. 17 showing the connector assembly in the unclamped position with the flash hider received therein.
Figure 19:
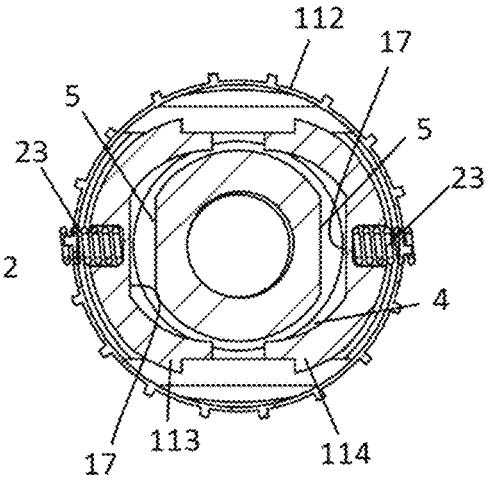
FIG. 19 is a sectional view on section line K-K in FIG. 17 showing the connector assembly in the unclamped position with the flash hider received therein.
Figure 20:
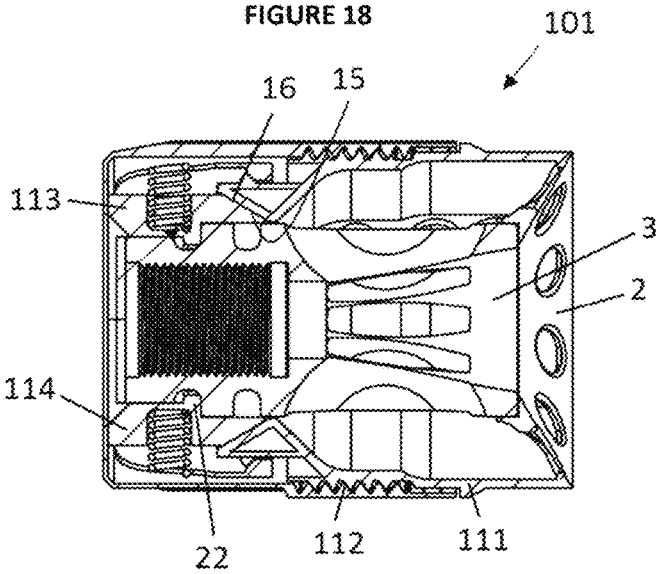
FIG. 20 is a sectional view on section line H-H in FIG. 16 showing the connector assembly in the clamped position connected to the flash hider.
Figure 21:
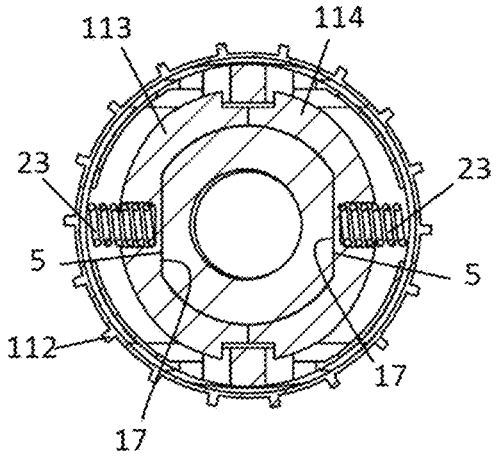
FIG. 21 is a sectional view on section line J-J in FIG. 16 showing the connector assembly in the clamped position connected to the flash hider.
Figure 22A:
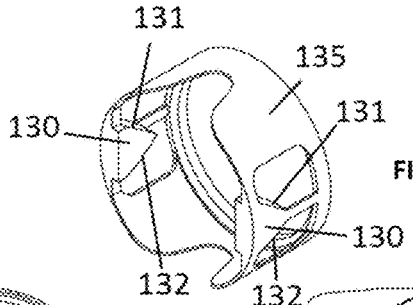
FIGS. 22A to 22C show a wedge component of the connector assembly of FIGS. 13 to 21.
Figure 22B:
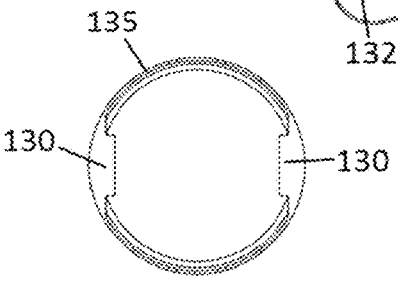
Figure 22C:
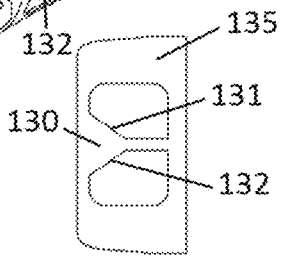
Figure 23:
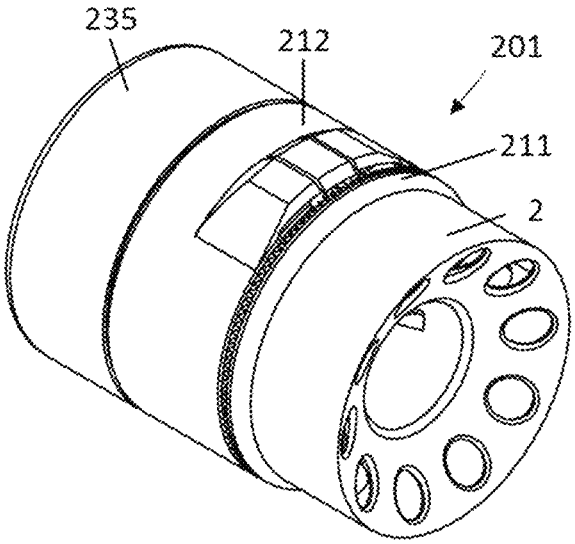
FIG. 23 is an isometric view of another connector assembly according to the present invention.
Figure 24:
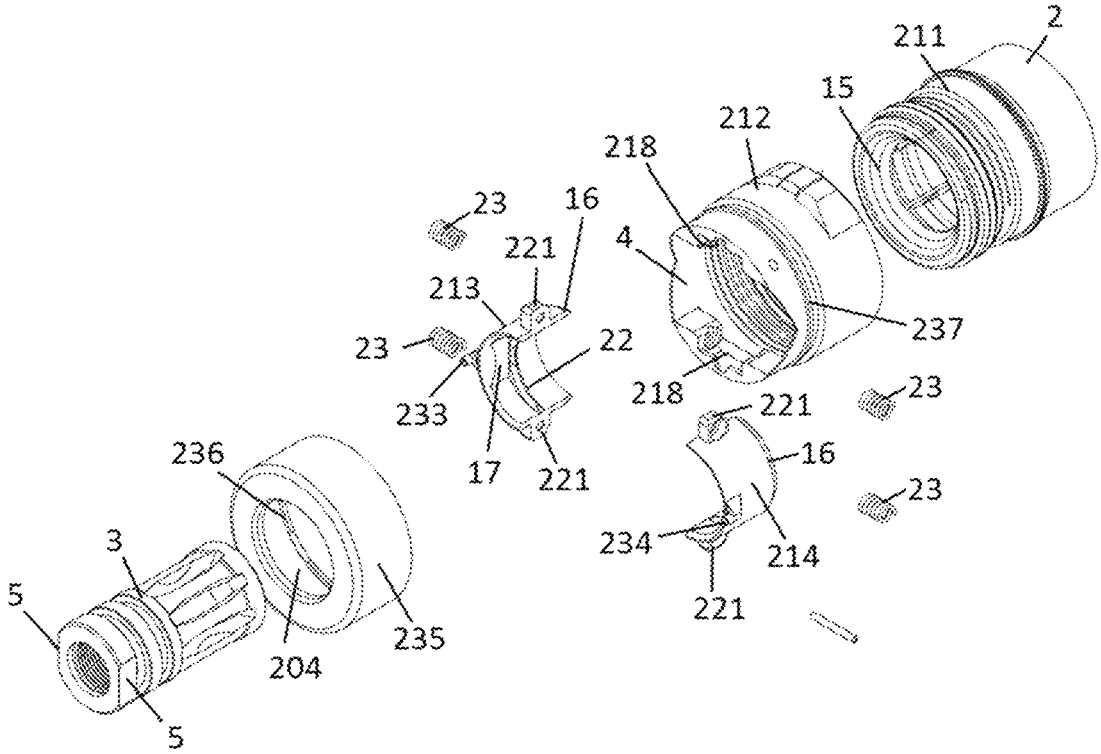
FIG. 24 is an exploded isometric view of the connector assembly and flash hider shown in FIG. 23.
Figure 25:
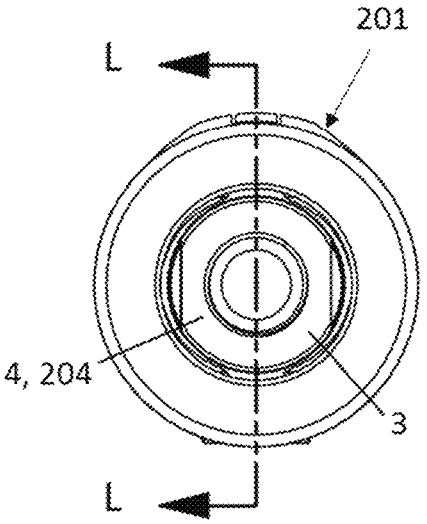
FIG. 25 is a view on an entry end of the connector assembly of FIG. 23 with flash hider received therein and with the connector assembly in an unclamped position.
Figure 26:
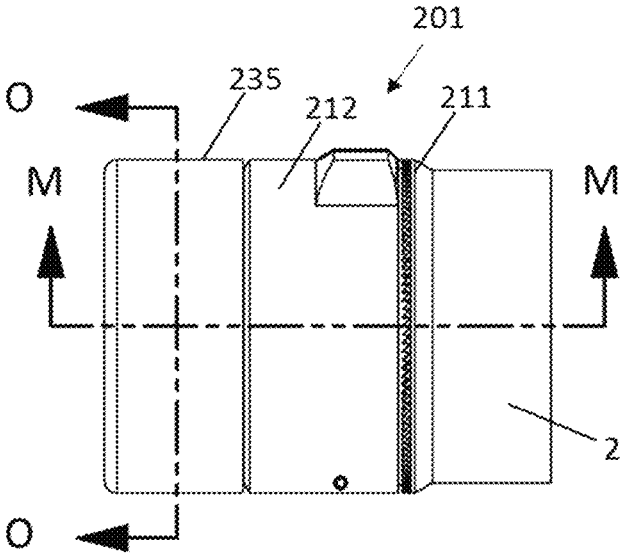
FIG. 26 is a side view of the connector assembly with the connector assembly in a clamped position and connected to the flash hider.
Figure 27:
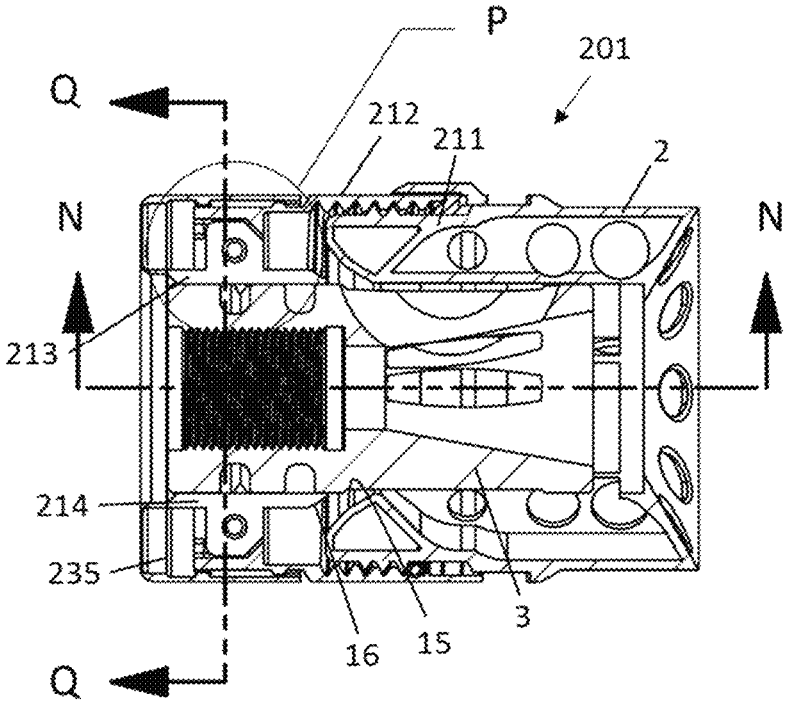
FIG. 27 is a sectional view on section line L-L in FIG. 25 showing the connector assembly in the unclamped position with the flash hider received therein.
Figure 28:
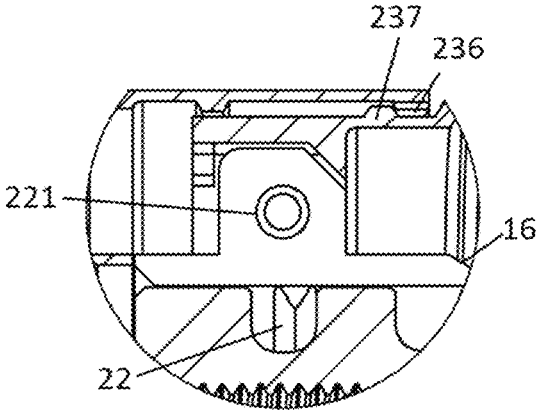
FIG. 28 is an enlarged view showing details in the circle designated P in FIG. 27.

With reference to FIGS. 13 to 22C, the connector assembly 101 includes a first connector part 111 and a second connector part 112 and two clamp members 113, 114. The clamp members are retained to the second connector part in an axial direction, for example by rails or grooves (not shown in FIGS. 13 to 22C) as described above with reference to FIGS. 5 and 6. Rotation of the first connector part 111 relative to the second connector part 112 moves the first and second connectors parts axially together and therefore moves the first connector part towards the clamp members to engage the first engagement surface 15 against the second engagement surfaces 16 to drive the clamp members 113, 114 radially inwards. In a radial inward position, the clamp members 113, 114 engage and clamp to the flash hider 3, by radial inward surfaces 17 engaging and clamping corresponding features on the flash hider 3, as described for the above earlier embodiment. FIGS. 20 and 21 show the clamp members in the radial inward or clamped position.

The connector assembly further comprises a wedge mechanism to drive the clamp members from the radial inwards (clamped) position to the radial outwards position to allow the flash hider to be inserted into and removed from the connector assembly. FIGS. 18 and 19 show the wedge mechanism operated to drive the clamp members 113, 114 to the radial outwards position.

The wedge mechanism comprises one or more wedge members 130 configured to engage each clamp member 113, 114 to drive the clamp members radially outwards. In the illustrated embodiment the wedge mechanism comprises two wedge members 130. Each wedge member comprises a first wedge surface 131 to engage a surface 133 on one clamp member 113 (a first said clamp member) and an oppositely arranged second wedge surface 132 to engage a surface 134 on an adjacent clamp member 114 (a second clamp member). The wedge member 130 is moved relative to the clamp members 113, 114 to wedge the adjacent clamp members apart. The clamp members are restrained to move radially relative to the central axis of the connector assembly. The wedge members wedge or drive the clamp members radially apart.

Unlike the earlier embodiment, in the embodiment of FIGS. 13 to 22C, the wedge members 130 move longitudinally, or axially relative to the second connector part 112 and the clamp members 113, 114. The wedge members 130 are coupled to the first connector part 111 so that as the first connector part 111 is moved axially towards the second connector part 112 and therefore the clamp members 113, 114, the wedge members move axially to allow the clamp members to move radially inwards to the radial inward position to clamp to the flash hider as described above. As the first connector part 111 is moved axially away from the second connector part 112 and therefore the clamp members 113, 114, the wedge members 130 move axially relative to the clamp members to drive the clamp members to move radially outward. The first and second wedge surfaces 131, 132 and/or the corresponding surfaces 133, 134 on the clamp members are inclined to the longitudinal line on which the wedge members move so that axial movement of the wedge members 130 as the first connector part 111 moves axially away from the second connector part 112 drives the clamp members 113, 114 radially outwards.

In the illustrated embodiment, the wedge members 130 are integrally formed together with an annular member or ring in a single wedge component 135. The wedge component 135 comprises the two wedge members 130. The wedge members are arranged diametrically apart. However, there may be a single wedge member to engage two clamp members, or there may be more than two wedge members where there are more than two clamp members. For example, in one embodiment there may be three clamp members and three wedge members.

The wedge component 135 is rotationally coupled to the first connector part 111 to allow relative rotation between the first connector part 111 and the wedge component 135 and wedge members 130, so that the wedge component moves axially without rotation as the first connector part 111 rotates to move axially. In the illustrated embodiment the wedge component 135 has a circumferentially extending shoulder 136 to engage and slide on circumferentially extending shoulders 137 on the first connector part (e.g. refer FIGS. 14 and 22A). However, the wedge component 135 may be coupled to the first connector part by a circlip or any other known connection to axially retain the wedge component 135 to the first connector part 111 but allow relative rotation therebetween.

To connect (clamp) the connector assembly to the flash hider the first connector part is rotated relative to the second connector part (and clamp members and wedge members) in a first direction of rotation to move the first connector part and the wedge members axially towards the second connector part and therefore the first connector part axially towards the clamp members. As the first connector part and wedge members are moved axially towards the first connector part, the wedge surfaces 131, 132 of the wedge members 130 move along or away from the surfaces 133, 134 on the clamp members 113, 114 to allow the clamp members to move radially inwards, and the first engagement surface 15 of the first connector part 111 moves along the second engagement surfaces 16 of the clamp members 113, 114 to drive the clamp members radially inwards to clamp the radially inward facing surfaces 17 of the clamp members 113, 114 to the respective features on the flash hider, as illustrated in FIGS. 20 and 21.

To remove or disconnect the connector assembly 101 from the flash hider, the first connector part is rotated relative to the second connector part (and clamp members and wedge members) in a second direction of rotation to move the first connector part axially away from the second connector part and therefore the clamp members. As the first connector part is moved axially away from the clamp members the first engagement surface 15 moves along or away from the second engagement surfaces 16 to allow the clamp members to move radially outwards. Furthermore, the wedge members 130 move axially together with the first connector part 111, so that the wedge surfaces 131, 132 of the wedge members 130 move along the corresponding surfaces 133, 134 on the clamp members 113, 114 to drive the clamp members 113, 114 radially outwards from the radial inwards position to the radial outwards position, as shown in FIGS. 18 and 19. Where the connector assembly 101 includes springs 23 to bias the clamp members inwards, axial movement of the wedge members 130 together with the first connector part 111 moves the clamp members 113, 114 radially outwards against the spring bias. When the clamp members have moved radially outwards to the radial outward position the connector assembly 101 can be removed from the flash hider.

Third Embodiment

FIGS. 23 to 34C illustrate a third embodiment of a connector assembly 201 according to the present invention. Parts or features that are the same or similar to parts or features of the embodiment 1 described above with reference to FIGS. 1 to 13 are identified by the same reference numerals or with a prefix of 2. Various parts or features of connector assembly 201 that are the same as parts or features of the above embodiment connector assembly 1 are not described again for brevity.

Figure 29:
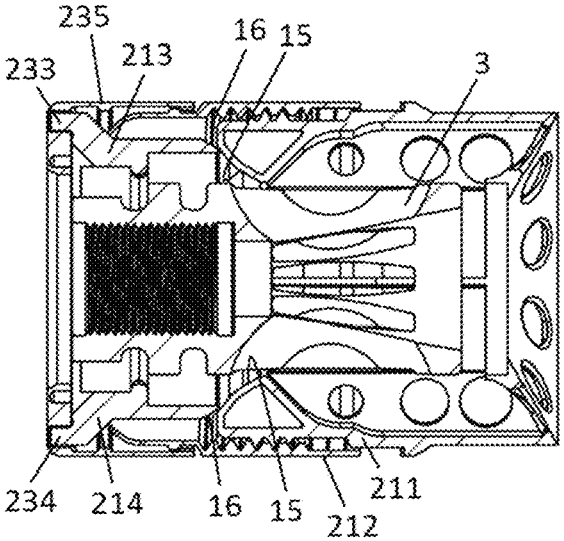
FIG. 29 is a sectional view on section line N-N in FIG. 27 showing the connector assembly in the unclamped position with the flash hider received therein.
Figure 30:
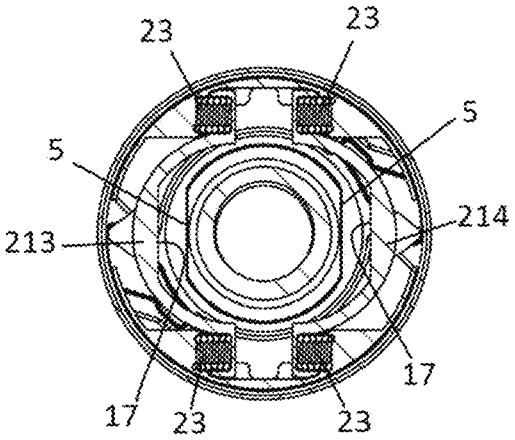
FIG. 30 is a sectional view on section line Q-Q in FIG. 27 showing the connector assembly in the unclamped position with the flash hider received therein.
Figure 31:
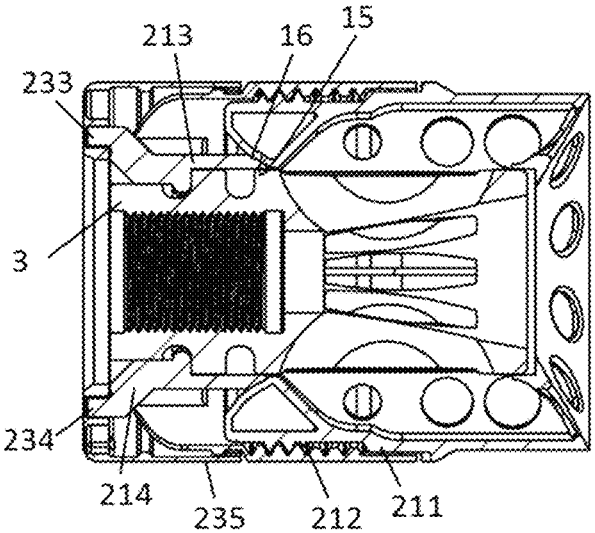
FIG. 31 is a sectional view on section line M-M in FIG. 26 showing the connector assembly in the clamped position connected to the flash hider.
Figure 32:
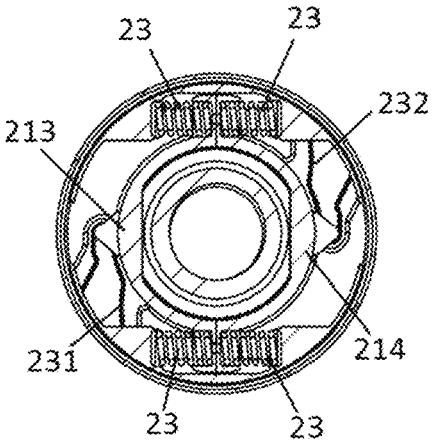
FIG. 32 is a sectional view on section line O-O in FIG. 26 showing the connector assembly in the clamped position connected to the flash hider.

With reference to FIGS. 23 to 33C, the connector assembly 201 includes a first connector part 211 and a second connector part 212 and two clamp members 213, 214. The clamp members are retained to the second connector part in an axial direction. For example, the clamp members 213, 214 each comprise projections 221 received in corresponding grooves or recesses 218 provided in the second connector part 212 (refer FIG. 24). The recesses extend perpendicular to the longitudinal axis of the connector assembly. The projections move along the corresponding recesses so that the clamp members move radially and perpendicular to the longitudinal axis of the connector assembly while preventing axial and rotational movement between the clamp members 213, 214 and the second connector part 212. Each clamp member has a pair of projections that are radially spaced apart in a radial direction perpendicular to a radial direction in which the clamp member move. The pair of projections are captured by a corresponding pair of recesses on the second connector part 212, so that the clamp members are only free to move relative to the second member radially inwards and radial outwards in a plane coincident with and perpendicular to the longitudinal axis of the connector assembly, as described for the first embodiment. Rotation of the first connector part 211 relative to the second connector part 212 moves the first and second connectors parts axially together and therefore moves the first connector part towards the clamp members to engage the first engagement surface 15 against the second engagement surfaces 16 to drive the clamp members 213, 214 radially inwards. In a radial inward position, the clamp members 213, 214 engage and clamp to the flash hider 3, by radial inward surfaces 17 engaging and clamping corresponding features on the flash hider 3, as described for the above earlier embodiment. FIGS. 31 and 32 show the clamp members in the radial inward or clamped position.

The connector assembly further comprises a cam mechanism to drive the clamp members from the radial inwards position to the radial outwards position to allow the flash hider to be inserted into and removed from the connector assembly. FIGS. 29 and 30 show the cam mechanism operated to drive the clamp members 213, 214 to the radial outwards position.

The cam mechanism comprises one or more cam surfaces configured to engage a cam follower to drive each clamp member radially outwards. In the illustrated embodiment, the cam mechanism comprises an annular cam component 235. The cam component has an aperture 204. The flash hider is inserted into and removed from the connector assembly via the aperture 204 of the cam component and the aperture 4 of the second connector part 212. The cam component is rotationally coupled to the second connector part to rotate relative to the second connector part on the longitudinal axis of the connector assembly. In the illustrated embodiment the cam component 235 has a circumferentially extending shoulder 236 to engage and slide on circumferentially extending shoulders 237 on the second connector part 212 (e.g. refer FIGS. 24 and 34A). However, the cam component 235 may be coupled to the second connector part by a circlip or any other known connection to axially retain the cam component 235 to the second connector part 212 but allow relative rotation therebetween.

Figure 33:
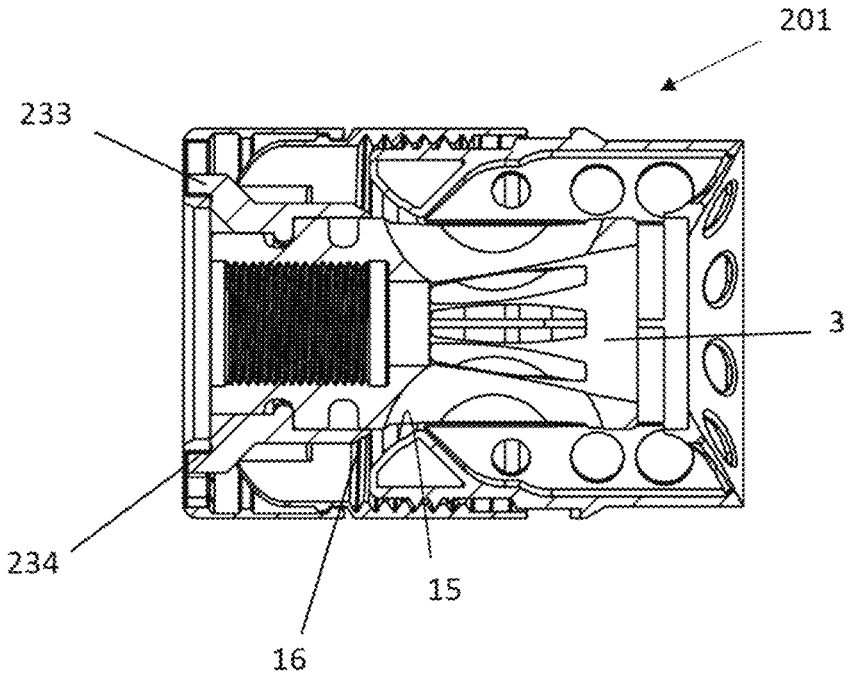
FIG. 33 is a sectional view on section line N-N in FIG. 27 with the connector assembly in the unclamped position but with a cam mechanism positioned so that clamp members are in a radial inward position.
Figure 34A:
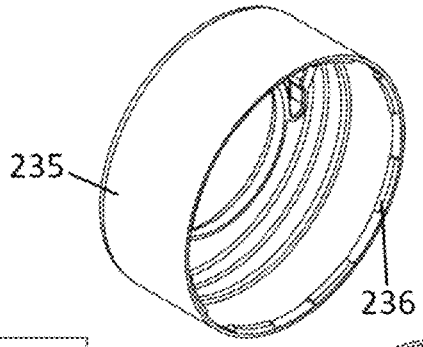
FIGS. 34A to 34C show a cam component of the connector assembly of FIGS. 23 to 33.
Figure 34B:
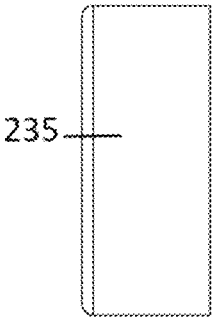
Figure 34C:
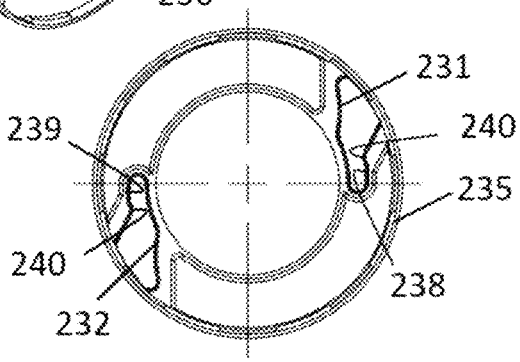

The cam component has a cam surface to act on a corresponding cam follower on each clamp member. In the illustrated embodiment, the cam component has a first cam surface 231 to act on a cam follower 233 on one (first) clamp member 213, and a second cam surface 232 to act on a cam follower 234 on the other (second) clamp member. The cam surfaces are provided on an axial wall of the cam component 235. The cam surfaces 231, 233 extend from a radial inward position to a radial outward position (FIG. 34C). Rotation of the cam component from a first position (FIG. 33) to a second position (FIG. 29) relative to the second connector part 212 causes the cam followers 233, 234 to move along the cam surfaces 231, 232 from the radial inward position to the radial outward position, to move the clamp members radially outwards from the radial inward position to the radial outward position. The illustrated embodiment is arranged so that approximately 45 degree rotation of the cam component moves the clamp members 213, 214 from the inward to outward positions.

With reference to FIG. 34C, in the illustrated embodiment, the cam component has a third cam surface 238 to act on the cam follower 233 on clamp member 213, and a fourth cam surface 239 to act on the cam follower 234 on the other clamp member 214. When the cam component is rotated to the second position, the third and fourth cam surfaces 238, 239 act on the cam followers 233, 234 to press the cam followers and therefore the clamp members 213, 214 radially inwards. Thus, the engagement surfaces 15, 16 drive the clamp members 213, 214 radially inwards at a forward end of the clamp members, and the cam surfaces 238, 239 drive the clamp members radially inwards at a rearward end of the clamp members. The cam component further comprises a radial inward projection 240 at a lead-in to each of the third and fourth cam surfaces. The cam followers 233, 234 must ride over the radial projections 240 to engage and disengage the third and fourth cam surfaces 238, 239. Each radial projection provides a tactile feedback to the user between the cam mechanism driving the clamp members radially inwards and the cam mechanism driving the clamp members radially outwards. With the cam component positioned so that the cam followers 233, 234 are positioned between the radial inward projection 240 and the first and second cam surfaces 231, 232, the clamp members are in a 'neutral position' being held against the flash hider by the spring bias only, and without the cam component driving the clamp members in the radial inward or outward directions.

In the illustrated embodiment, the cam followers 233, 234 are on the clamp members 213, 214 and the cam surfaces 231, 232 are on the cam component 235. However, one skilled in the art will appreciate that the cam followers may be provided on the cam component and the cam surfaces on the first and second clamp members.

To connect (clamp) the connector assembly 201 to the flash hider 3 the cam component is rotated from the first position to the second position to move the clamp members radially outwards (FIGS. 29, 30) and the connector assembly is fitted over the flash hider 3. Where fitted, the springs drive the clamp members to the radial inward position when the cam component is released. The biasing of the springs biases rotation of the cam component away from the second position with the clamp members in the radial inwards position (FIG. 33). The first connector part is then rotated relative to the second connector part (and clamp members) in a first direction of rotation to move the first connector part axially towards the second connector part and therefore the first connector part axially towards the clamp members. The first engagement surface 15 of the first connector part 211 moves along the second engagement surfaces 16 of the clamp members 213, 214 to drive the clamp members radially inwards to clamp the radially inward facing surfaces 17 of the clamp members 213, 214 to the respective features on the flash hider, as illustrated in FIGS. 31 and 32. Where provided with the third and fourth cam surfaces, the cam component may be rotated to the first position, to also drive the clamp members against the flash hider (FIGS. 31, 32).

To remove or disconnect the connector assembly 201 from the flash hider, the first connector part is rotated relative to the second connector part (and clamp members) in a second direction of rotation to move the first connector part axially away from the second connector part and therefore the clamp members. As the first connector part is moved axially away from the clamp members the first engagement surface 15 moves along or away from the second engagement surfaces 16 to allow the clamp members to move radially outwards. Where springs are provided, the springs retain the clamp members in the radially inward position, even when the first connector part is in the first position (FIG. 33). The cam component 235 is then rotated from the first position to the second position to drive the clamp members radially outwards from the radial inwards position to the radial outwards position (FIGS. 29 and 30). This drives the clamp members outwards against the spring bias. When the clamp members have moved radially outwards to the radial outward position the connector assembly 201 can be removed from the flash hider.

Fourth Embodiment

FIGS. 35 to 45C illustrate a fourth embodiment of a connector assembly 301 according to the present invention. Parts or features that are the same or similar to parts or features of the embodiment 1 described above with reference to FIGS. 1 to 12C are identified by the same reference numerals or with a prefix of 3. Various parts or features of connector assembly 301 that are the same as parts or features of the above embodiment connector assembly 1 are not described again for brevity.

Figure 40:
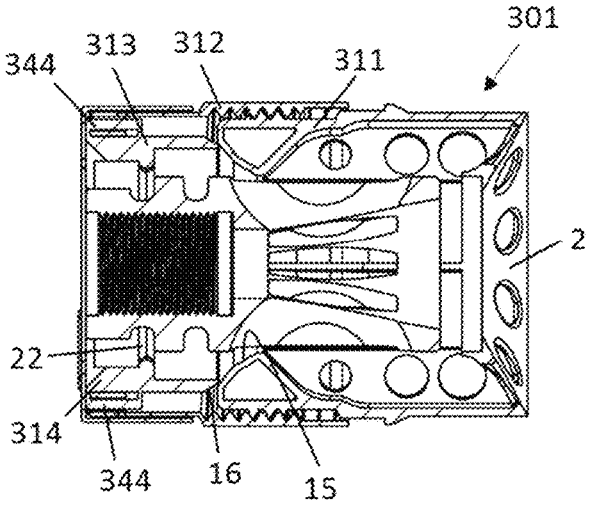
FIG. 40 is a sectional view on section line T-T in FIG. 39 showing the connector assembly in the unclamped position with the flash hider received therein.
Figure 41:
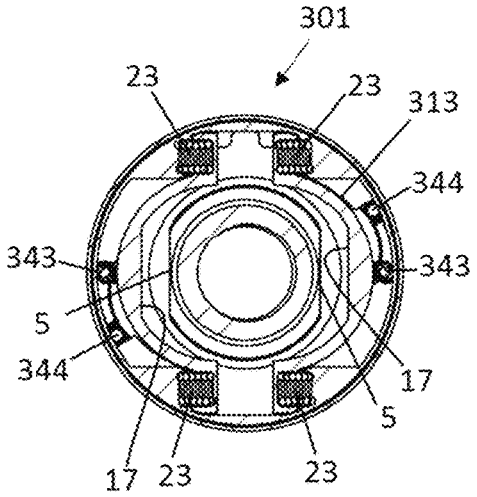
FIG. 41 is a sectional view on section line V-V in FIG. 39 showing the connector assembly in the unclamped position with the flash hider received therein.
Figure 42:
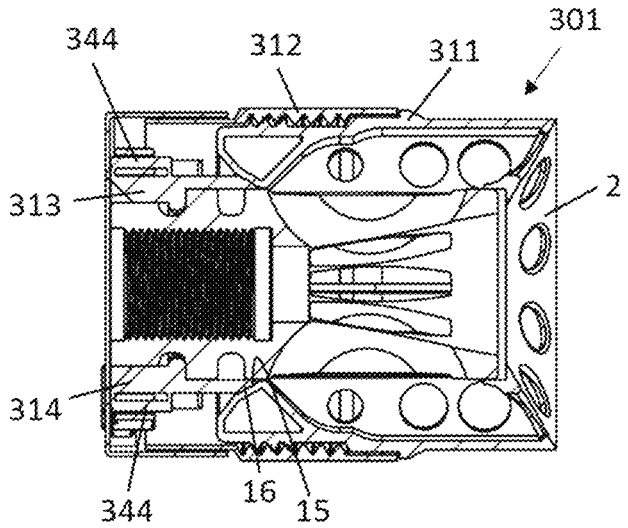
FIG. 42 is a sectional view on section line S-S in FIG. 38 showing the connector assembly in the clamped position connected to the flash hider.
Figure 43:
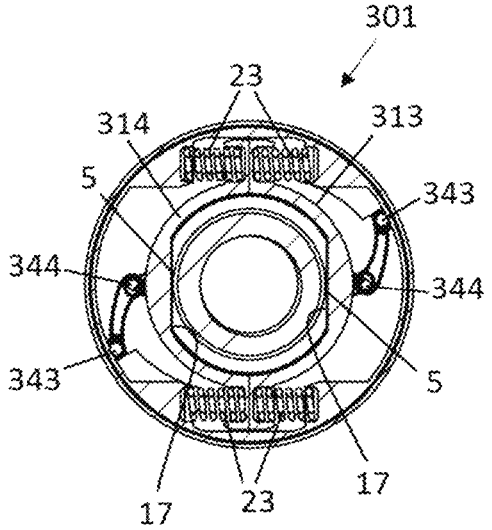
FIG. 43 is a sectional view on section line U-U in FIG. 38 showing the connector assembly in the clamped position connected to the flash hider.

With reference to FIGS. 35 to 45C, the connector assembly 301 includes a first connector part 311 and a second connector part 312 and two clamp members 313, 314. The clamp members are retained to the second connector part in an axial direction. The coupling of clamp members 313, 314 to the second connector part 312 is as described above for the third embodiment, so that the clamp members 313, 314 move radially and perpendicular to the longitudinal axis of the connector assembly to move relative to the second member radially inwards and radial outwards in a plane coincident with and perpendicular to the longitudinal axis of the connector assembly. Rotation of the first connector part 311 relative to the second connector part 312 moves the first and second connectors parts axially together and therefore moves the first connector part towards the clamp members to engage the first engagement surface 15 against the second engagement surfaces 16 to drive the clamp members 313, 314 radially inwards. In a radial inward position, the clamp members 313, 314 engage and clamp to the flash hider 3, by radial inward surfaces 17 engaging and clamping corresponding features on the flash hider 3, as described for the above earlier embodiments. FIGS. 42 and 43 show the clamp members in the radial inward or clamped position.

The connector assembly further comprises a lever mechanism to drive the clamp members from the radial inwards (clamped) position to the radial outwards position to allow the flash hider 3 to be inserted into and removed from the connector assembly 301. The lever mechanism comprises a lever 341, 342 pivotally connected to each clamp member 313, 314. FIGS. 40 and 41 show the levers 341, 342 operated to drive the clamp members 313, 314 to the radial outwards position.

Figure 35:
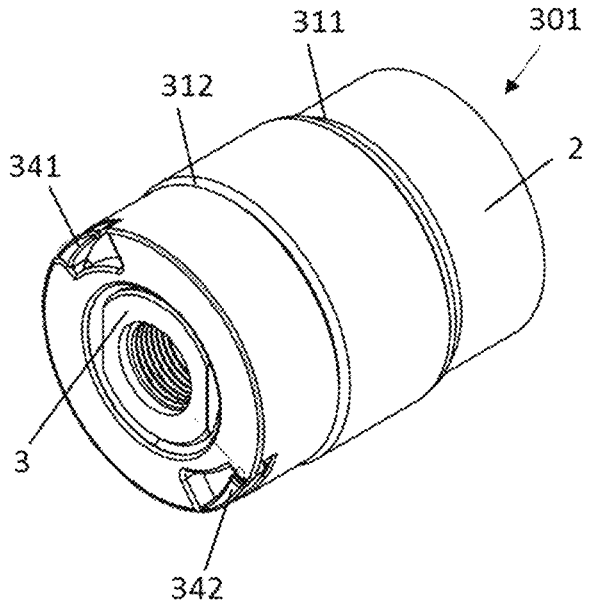
FIG. 35 is an isometric view of another connector assembly according to the present invention.
Figure 36:
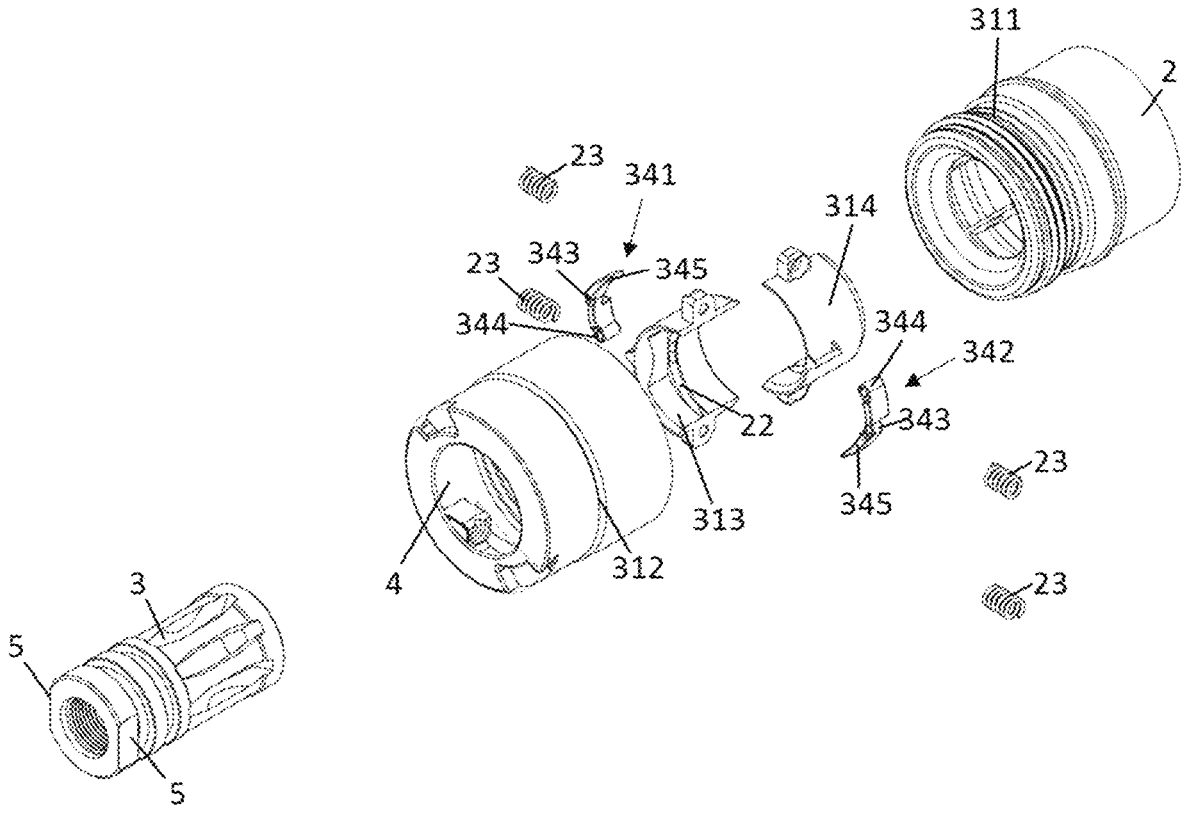
FIG. 36 is an exploded isometric view of the connector assembly and flash hider shown in FIG. 35.
Figure 37:
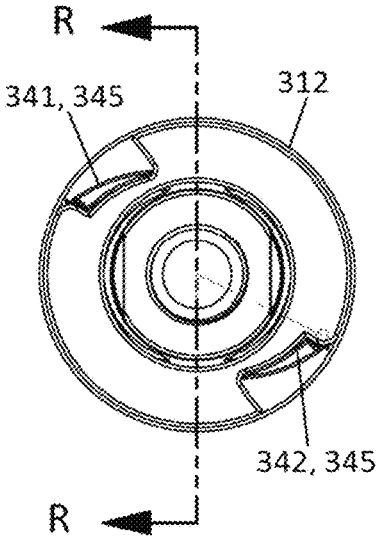
FIG. 37 is a view on an entry end of the connector assembly of FIG. 35 with flash hider received therein and with the connector assembly in an unclamped position.
Figure 38:
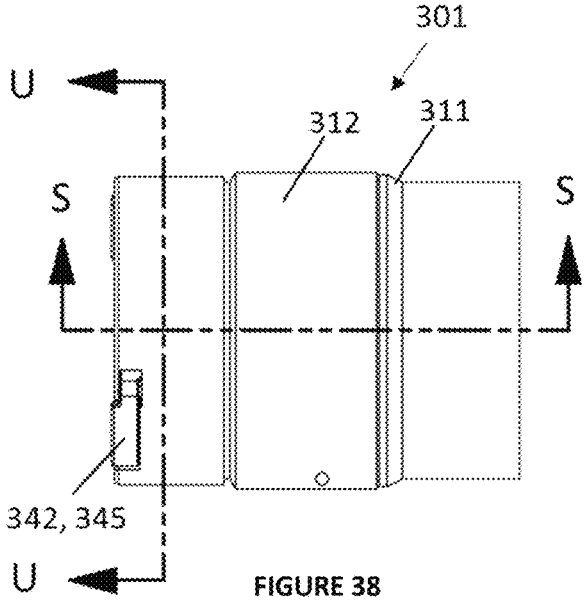
FIG. 38 is a side view of the connector assembly with the connector assembly in a clamped position and connected to the flash hider.
Figure 39:
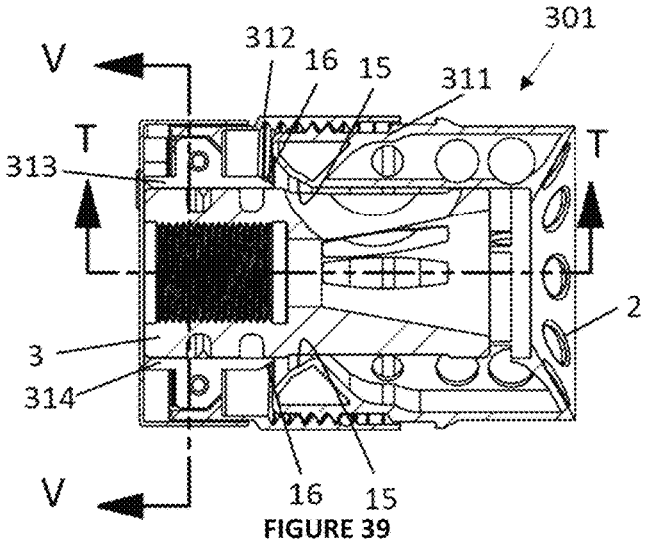
FIG. 39 is a sectional view on section line R-R in FIG. 37 showing the connector assembly in the unclamped position with the flash hider received therein.

Each lever 341, 342 is pivotally coupled at a fulcrum 343 to the second connector part 312. In the illustrated embodiment each lever is pivotally coupled to an annular member 346 that is connected to the second connector part, e.g. by welding. The annular member may be considered part of the second connector part 312. A coupled end 344 of the lever is pivotally attached to a clamp member, and a free end 345 of the lever extends from the fulcrum to be accessible from an outside of the second connector part. With the clamp members at the radially inward position, the levers are pivoted about the fulcrum to present the free end of the levers at an outward position, as shown in FIGS. 35, 38 and 43. To drive the clamp members radially outwards, a user presses the free ends 345 of the levers 341, 342 to move the free ends of the levers to an inwards position, pivoting the levers at the fulcrum 343 to move the coupled end of the levers and the clamp members to the radially outwards position. In the illustrated embodiment the connector assembly comprises two diametrically opposed clamp members and two diametrically opposed levers.

To connect (clamp) the connector assembly 301 to the flash hider 3 the free ends of the levers are pressed inwards to move the clamp members to the radial outwards position and the connector assembly is fitted over the flash hider 3. Where fitted, the springs drive the clamp members to the radial inward position when the levers are released. The biasing of the springs biases the free ends of the levers outwards. The first connector part is then rotated relative to the second connector part (and clamp members) in a first direction of rotation to move the first connector part axially towards the second connector part and therefore the first connector part axially towards the clamp members. The first engagement surface 15 of the first connector part 311 moves along the second engagement surfaces 16 of the clamp members 313, 314 to drive the clamp members radially inwards to clamp the radially inward facing surfaces 17 of the clamp members 313, 314 to the respective features on the flash hider, as illustrated in FIGS. 42 and 43.

Figure 44:
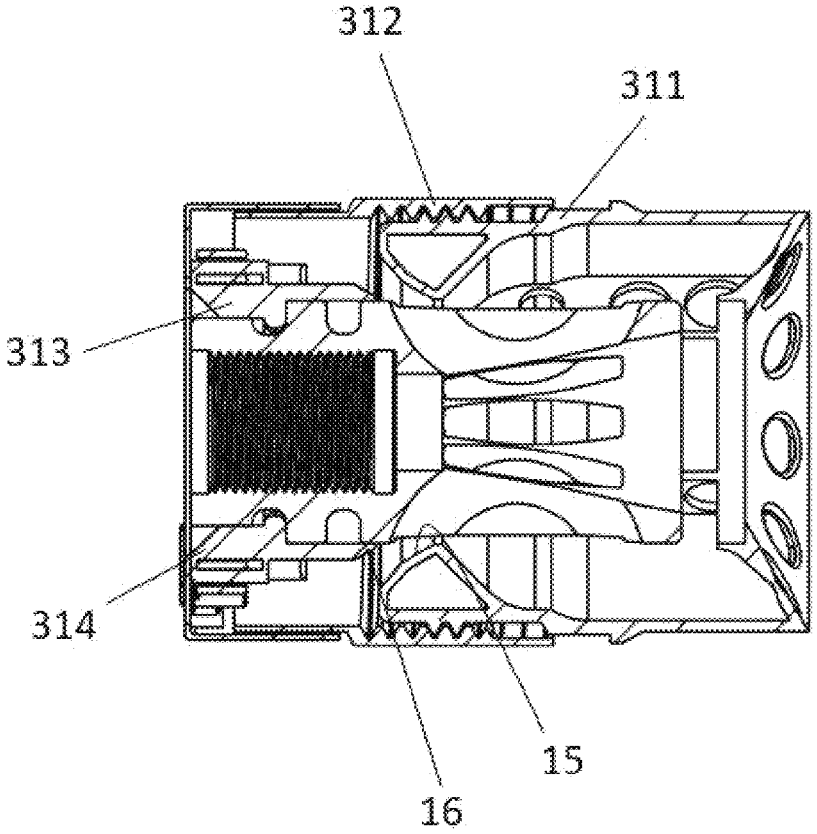
FIG. 44 is a sectional view on section line T-T in FIG. 39 with the connector assembly in the unclamped position but with a lever mechanism positioned so that clamp members are in a radial inward position.
Figure 45A:
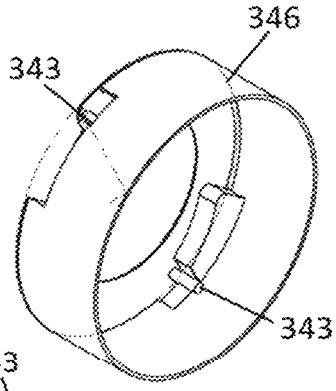
FIGS. 45A to 45C show a cap component of the connector assembly of FIGS. 35 to 44.
Figure 45B:
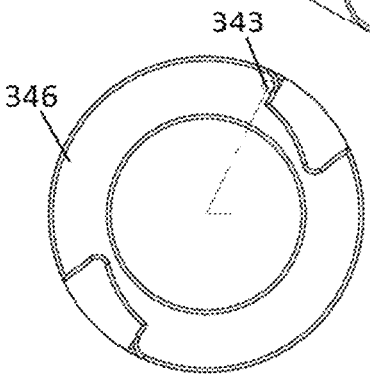
Figure 45C:
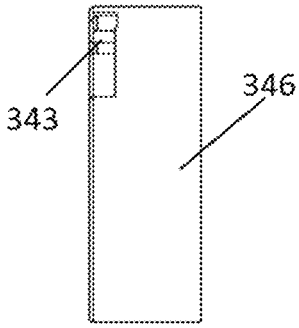
Figure 46:
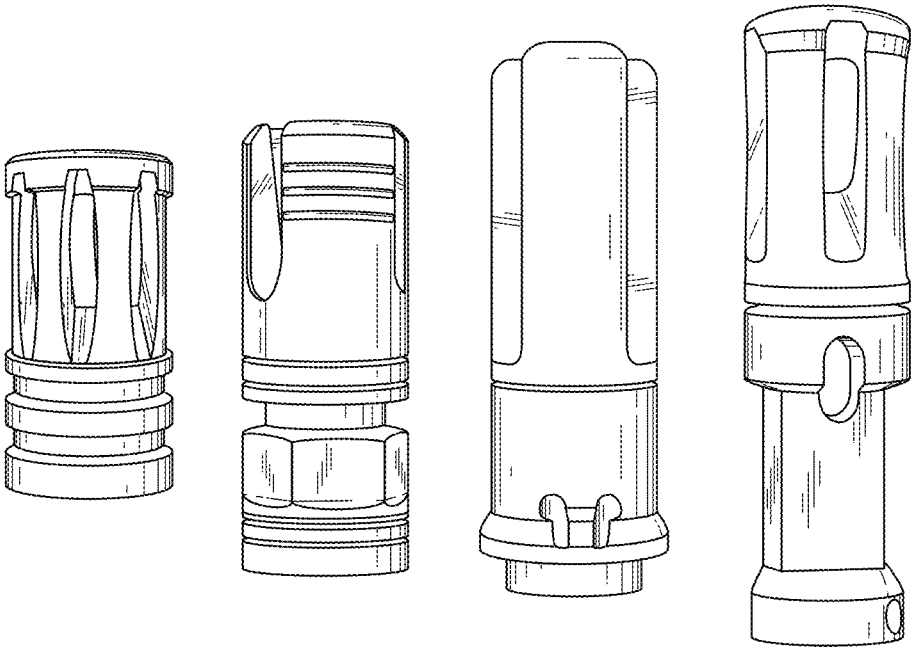
FIG. 46 is an image of prior art flash hiders.
Figure 47:
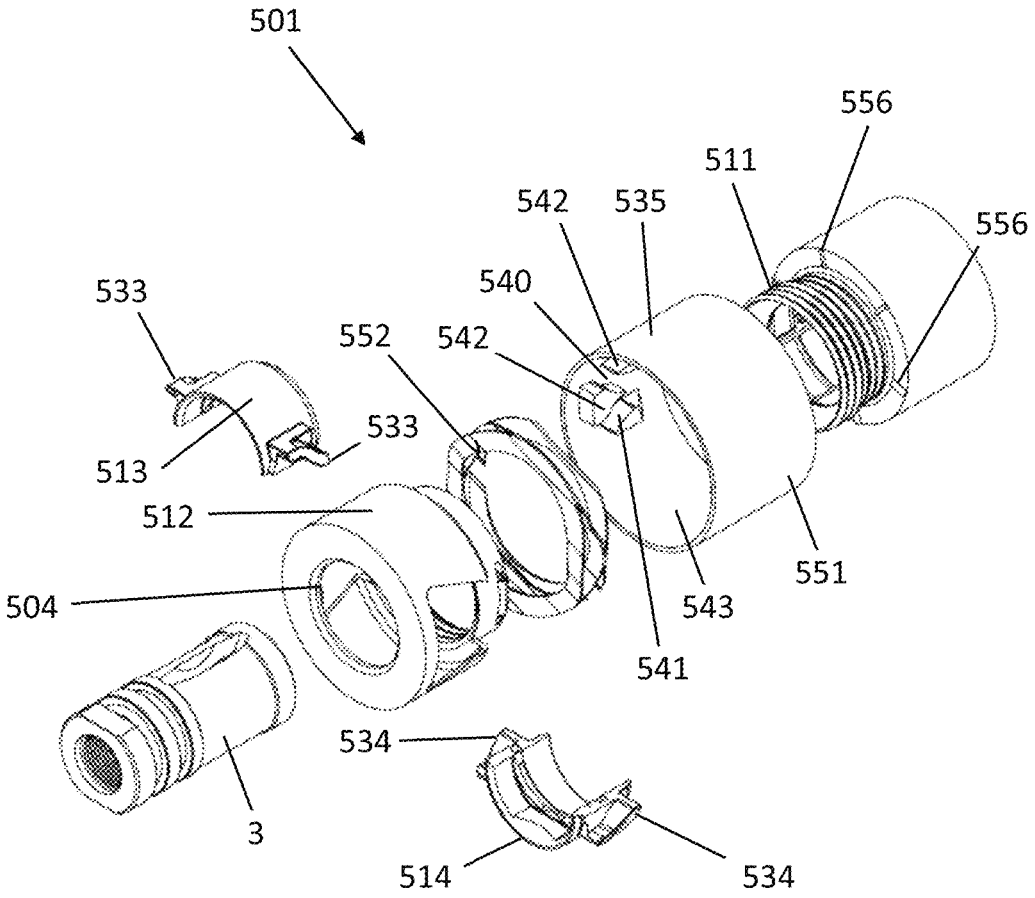
FIG. 47 is an exploded isometric view of a flash hider and another connector assembly according to the present invention.
Figure 48:
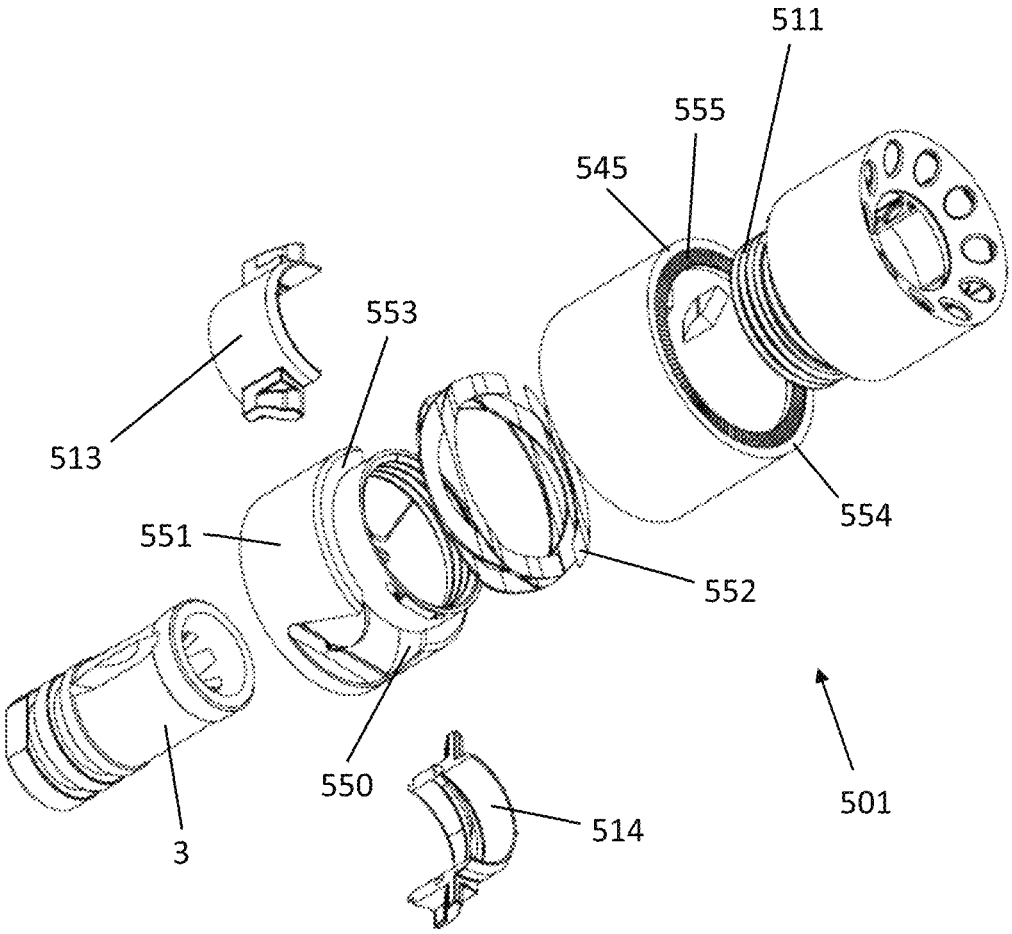
FIG. 48 is an alternative exploded isometric view of the flash hider and connector assembly of FIG. 47.
Figure 49:
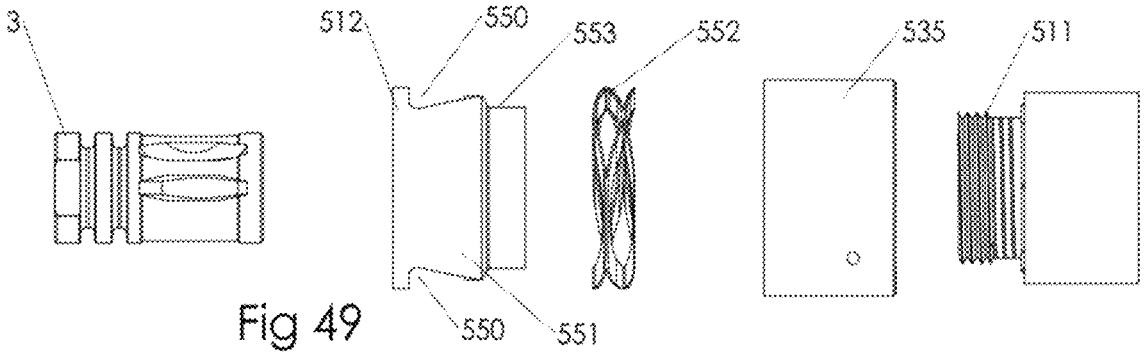
FIG. 49 is an exploded side view of the connector assembly of FIG. 47, excluding the clamp members.
Figure 50:
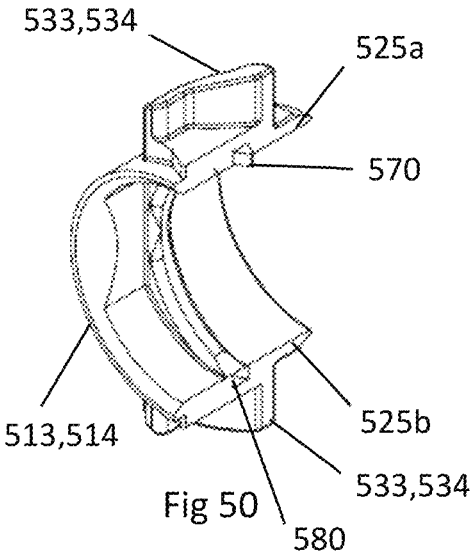
FIG. 50 is an isometric view of a clamp member of the connector assembly of FIG. 47.
Figure 50A:
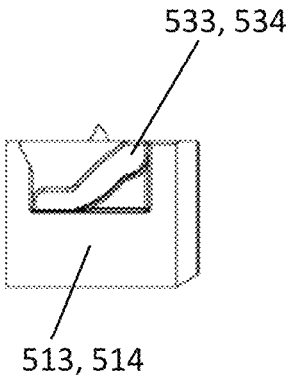
FIG. 50*a* is a side view of the clamp member of the connector assembly of FIG. 47.
Figure 51:
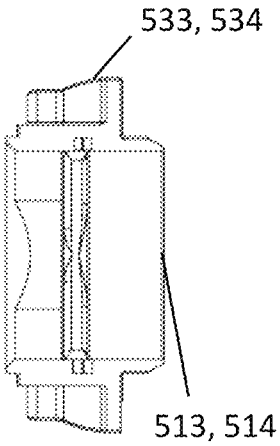
FIG. 51 is an inner side view of a clamp member of the connector assembly of FIG. 47.
Figure 52:
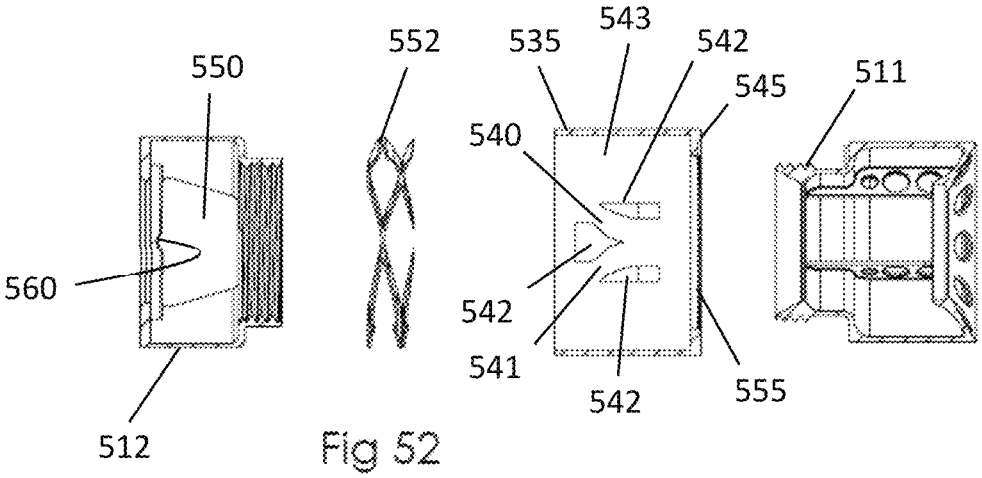
FIG. 52 is an exploded cross-section side view of the connector assembly of FIG. 47, excluding the clamp members.
Figure 53:
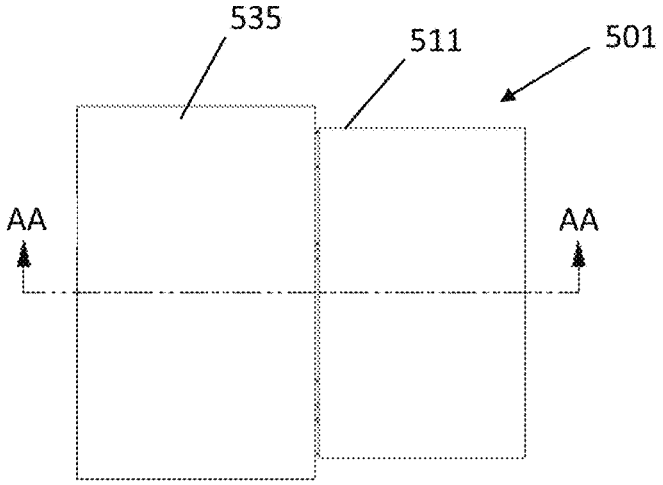
FIG. 53 shows a side view of the connector assembly of FIG. 47 in a clamped configuration.
Figure 54:
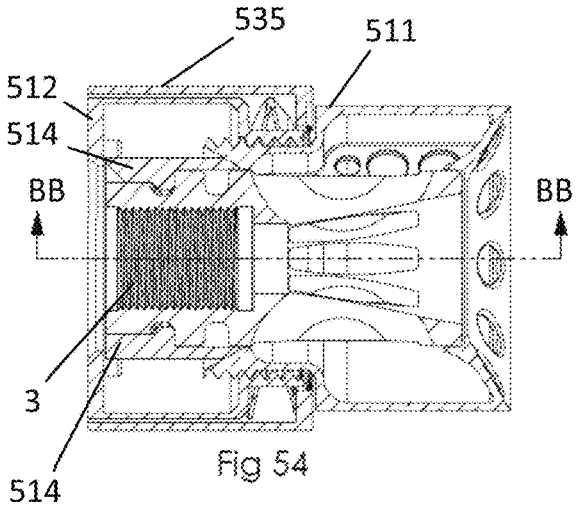
FIG. 54 is a sectional view on section line AA-AA in FIG. 53.
Figure 55:
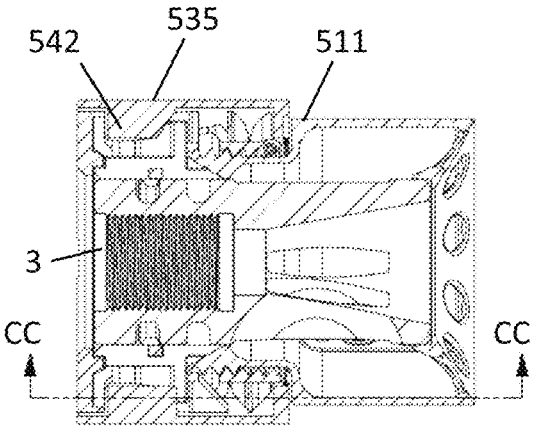
FIG. 55 is a sectional view on section line BB-BB in FIG. 54.
Figure 56:
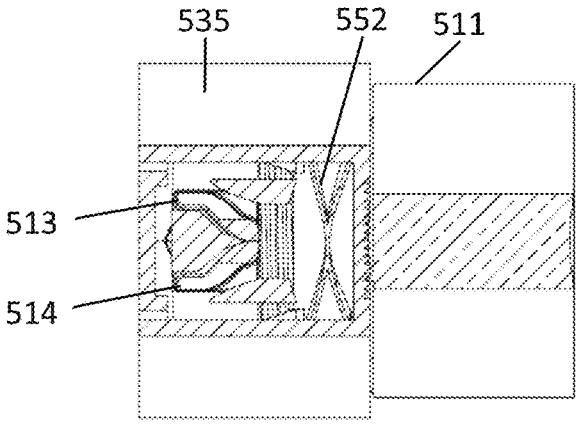
FIG. 56 is a sectional view on section line CC-CC in FIG. 55.
Figure 57:
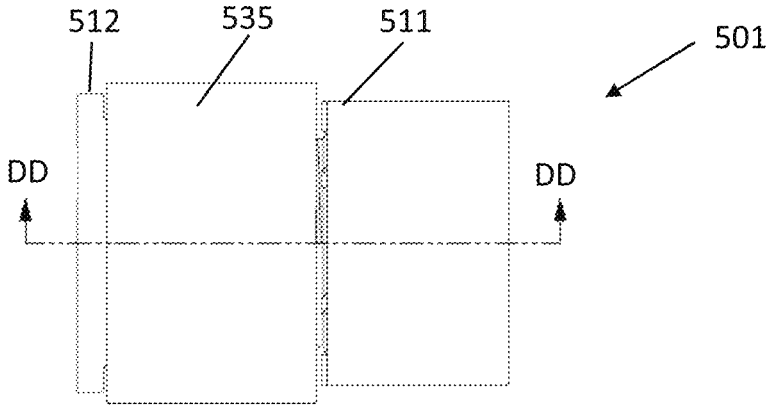
FIG. 57 shows a side view of the connector assembly of FIG. 47 in an unclamped configuration.
Figure 58:
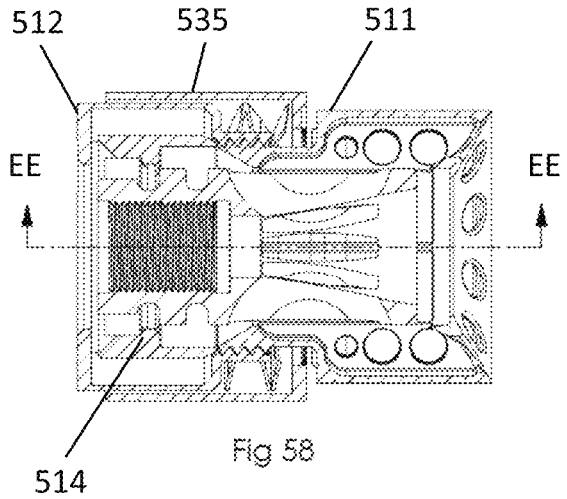
FIG. 58 is a sectional view on section line DD-DD in FIG. 57.
Figure 59:
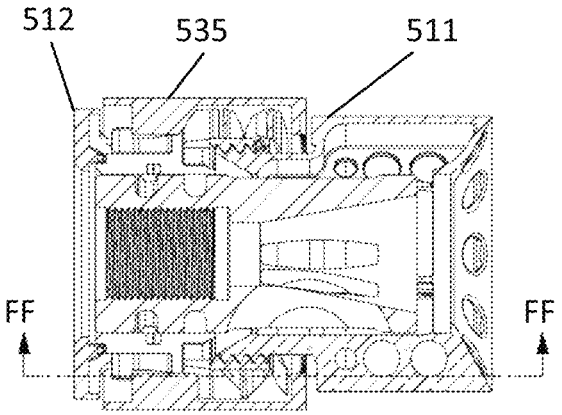
FIG. 59 is a sectional view on section line EE-EE in FIG. 58.
Figure 60:
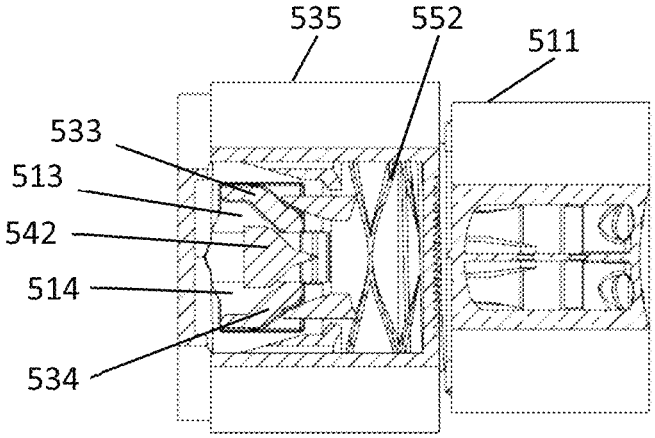
FIG. 60 is a sectional view on section line FF-FF in FIG. 59.

To remove or disconnect the connector assembly 301 from the flash hider, the first connector part is rotated relative to the second connector part (and clamp members) in a second direction of rotation to move the first connector part axially away from the second connector part and therefore the clamp members. As the first connector part is moved axially away from the clamp members the first engagement surface 15 moves along or away from the second engagement surfaces 16 to allow the clamp members to move radially outwards. Where springs are provided, the springs retain the clamp members in the radially inward position, even when the first connector part is in the first position (FIG. 44). The free ends of the levers are pressed inwards to drive the clamp members radially outwards from the radial inwards position to the radial outwards position (FIGS. 40 and 41). This drives the clamp members outwards against the spring bias. When the clamp members have moved radially outwards to the radial outward position the connector assembly 301 can be removed from the flash hider.

Fifth Embodiment

FIGS. 47 to 58 illustrate a fifth embodiment of a connector assembly 501 according to the present invention. Parts or features that are the same or similar to parts or features of the embodiment 1 described above with reference to FIGS. 1 to 12C are identified by the same reference numerals or with a prefix of 5. Various parts or features of connector assembly 501 that are the same as parts or features of the above embodiment connector assembly 1 are not described again for brevity.

The connector assembly 501 includes a first connector part 511 and a second connector part 512 and two clamp members 513, 514. The clamp members 513, 514 are retained to the second connector part 512 in an axial direction, as is described further below.

The connector assembly 501 further comprises a cam mechanism to drive the clamp members 513, 514 from the radially inward position to the radially outward position, to allow the flash hider 3 to be inserted into and removed from the connector assembly 501. FIGS. 57 to 60 show the cam mechanism operated to drive the clamp members 513, 514 to the radial outwards position.

The cam mechanism comprises one or more cam surfaces configured to engage a cam follower to drive each clamp member radially inwards or radially outwards as required. In the illustrated embodiment, the cam mechanism comprises a cylindrical component 535. The cylindrical cam component 535 is configured to fit over the second connector part 512 and to engage the second connector part 512 in a sliding fit.

The flash hider 3 is inserted into and removed from the connector assembly 501 via an aperture 504 of the second connector part 512.

In the illustrated embodiment the cam component 535 comprises two pairs of cam races 540, 541, each of which define opposing cam surfaces. The cam races 540, 541 define divergent paths. In the illustrated example the cam races 540, 541 are defined by a group of projecting portions 542 which project radially inward from an inner surface 543 of the cam component. In examples, the cam races 540, 541 are open towards a first end 545 of the cam component 535.

The first clamp member 513 comprises cam follower portions 533 at each end of the clamp member 513 and the second claim member 514 comprises cam follower portions 534 at each end of the clamp member 514. Each cam follower portion 533, 534 is configured to extend radially outward from the respective clamp member 513, 514.

The clamp members 513, 514 are located inside the second connector part 512. The second connector part comprises apertures 550 in the annular wall 551 through which the cam follower portions 533, 534 can extend in order to engage the cam races 540, 541.

The cam component 535 is biased towards the first connector component 511 by a spring 552. The spring 552 may be provided between a shoulder 553 of the second connector component 512 and an internal surface of a radially inwardly extending end wall 554 provided at the first end 545 of the cam component 535. In examples, the outer surface of the radially extending end wall 554 may be provided with a plurality of indexing features, e.g. axially extending teeth, which engage complementary indexing features 556 provided to a shoulder of the first connector part 512. In examples the indexing features 555, 556 form a Hirth joint. The indexing features 555, 556 resist rotation of the cam component 535 relative to the first component 511 when the cam component 535 is urged against the first component 511 by the spring 552.

When the second connector component 512 is tightened onto the first connector 511 the cam component 535 is held against the first component 511 by the compressed spring 552 and the second component 512 moves towards the first component 511. This movement moves the clamp members 513, 514 towards the first component 511 and moves the cam followers 533, 534 relative to the cam races 540, 541. This movement of the cam followers 533, 534 relative to the cam races 540, 541 causes the clamp members 513, 514 to be moved radially inward to a position in which they can engage a surface or feature on the flash hider 3.

In examples, final engagement of the clamp members 513, 514 with the flash hider 3 may be achieved by engagement of a tapered or inclined (e.g. conical) engagement surface 515 with the clamp members 513, 514, in a similar manner to the example shown in FIGS. 13-22. In examples, the second connector component 512 may be provided with an opposing tapered or inclined surface 560 to act on the opposite side of each clamp member 513, 514.

To release the connector 501 from the flash hider 3, the cam component 535 is urged away from the first connector portion 511, against the spring 552. The first connector component 511 can then be rotated relative to the second connector component 512, for example by three full turns. Movement of the first connector component 511 away from the second connector component 512 releases the clamp members 513, 514 from the action of the engagement surface 515 and opposed surface 560.

When the cam component 535 is released, the spring 552 again urges the cam component 535 towards the first component 511. This causes relative movement between the second component 512 and the cam component 535. The consequential movement of the cam races 540, 541 relative to the cam followers 533, 534 causes the clamp members 513, 514 to be moved radially outward to a position in which they disengage a surface or feature on the flash hider 3.

In one form of the technology each clamp member 513, 514 may be provided with a tapered projection 570 which extends from one longitudinal face 525*a* of the clamp member 513, 514. The opposite longitudinal face 525*b* may be provided with a complementary recess 580. In use, each projection 570 engages the recess 580 of the opposing clamping member, to thereby provide a check for the gas, in the event the longitudinal faces 525*a*, 525*b* are not touching when the flash hider is fully engaged.

Aspects of the present invention have been described by way of example only and it should be appreciated that modifications and additions may be made thereto without departing from the scope thereof as defined in the appended claims. The invention has been described with reference to the connection of a suppressor to a flash hider by example only. One skilled in the art will appreciate that the invention described herein may be used to connect any firearm accessory to a muzzle device attached to the muzzle of a firearm. For example, a connector according to the invention may be used to connect a suppressor, a blank firing adapter, a blast redirector device or other accessory to a flash hider or other muzzle device such as a muzzle brake or recoil compensator.

While the invention has been described in connection with what are presently considered to be the most practical and preferred embodiments, it is to be understood that the invention is not to be limited to the disclosed embodiments. On the contrary, it is intended that the specification covers various modifications and equivalent arrangements included within the spirit and scope of the invention. Also, the various embodiments described above may be implemented in conjunction with other embodiments, e.g., aspects of one embodiment may be combined with aspects of another embodiment to realize yet other embodiments, Further, each independent feature or member of any given assembly may constitute an additional embodiment.

What I claim is:

1. A connector assembly for connecting a firearm accessory to a muzzle device for a firearm, the connector assembly comprising:

a first connector part, and a second connector part engaged to the first connector part by a threaded engagement, the first connector part presenting a first engagement surface, at least two clamp members configured to receive the muzzle device therebetween, the clamp members coupled to the second connector part to be axially and rotationally retained thereto, each of the clamp members presenting a second engagement surface to engage the first engagement surface, and wherein rotation of the first connector part relative to the second connector part in a first direction moves the first connector part from a first relative axial position to a second relative axial position to engage the first engagement surface against the second engagement surfaces to drive the clamp members radially inwards against the muzzle device in an inward radial position to clamp the muzzle device and connect the firearm accessory to the firearm, wherein the connector assembly further comprises a mechanism to drive the clamp members from the inward radial position to an outward radial position when the first connector part is in or moved to the first relative axial position to allow a muzzle device to be received in or removed from the connector assembly, wherein the mechanism comprises a cam component configured to engage an outer surface of the second connector part and to move longitudinally with respect to the first and second connector parts, and wherein the cam component does not rotate relative to the second connector component.

2. The connector as claimed in claim 1, wherein the first and/or second engagement surface comprises a conical portion.

3. The connector as claimed in claim 1, wherein radially inward facing surfaces of the clamp members clamp respective features on the muzzle device without a clamping force applied between other surfaces of the clamp members and the muzzle device.

4. The connector as claimed in claim 1, wherein the mechanism is a wedge or cam mechanism comprising one or more wedge members or cam surfaces configured to engage each of a respective clamp member to drive the clamp members radially outwards.

5. The connector as claimed in claim 1, wherein the clamp members are captured axially between the first connector part and the second connector part.

6. The connector as claimed in claim 1, wherein the connector comprises two diametrically opposed clamp members.

7. The connector as claimed in claim 1, wherein the first connector part is screwed to or integrally formed with a body of the firearm accessory at an entry end of the body.

8. The connector of claim 1 wherein the clamp members are provided inside the second connector component and the second connector component comprises apertures in opposed sides thereof, the apertures configured to allow cam follower portions provided at opposite ends of each clamp member to extend through the apertures, and wherein the cam component comprises a substantially cylindrical outer wall and two pairs of cam races provided to an inner surface of the cylindrical outer wall, each cam race configured to engage a respective cam follower.

9. The connector of claim 1 comprising biasing means provided between the cam component and the second connector component and configured to bias the cam component towards the first connector component.

10. The connector of claim 9, wherein the cam component comprises first indexing means configured to engage first and second indexing means provided to the first connector component, the indexing means configured to resist relative rotation of the cam component and the first connector component when the first indexing means is engaged with the second indexing means.

11. The connector of claim 9 wherein the first and/or second engagement surfaces comprise conical portions and wherein the second connector part comprises a further conical portion configured to engage the clamp members to drive the clamp members radially inwards against the muzzle device.

12. The connector of claim 11 wherein each clamp member comprises a tapered projection on a first longitudinal face and a complementary recess on an opposite longitudinal face, such that in use, the tapered projection of one of the clamp members engages the recess of the other clamp member.

* * * * *